US006943766B2

(12) United States Patent
Nakamura et al.

(10) Patent No.: US 6,943,766 B2
(45) Date of Patent: Sep. 13, 2005

(54) DISPLAY APPARATUS, DISPLAY SYSTEM AND METHOD OF DRIVING APPARATUS

(75) Inventors: Takashi Nakamura, Saitama-Ken (JP); Hirotaka Hayashi, Saitama-Ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 222 days.

(21) Appl. No.: 10/303,770

(22) Filed: Nov. 26, 2002

(65) Prior Publication Data

US 2003/0098860 A1 May 29, 2003

(30) Foreign Application Priority Data

Nov. 28, 2001 (JP) ..... 2001-362175
Mar. 4, 2002 (JP) ..... 2002-057701

(51) Int. Cl.[7] ..... G09G 1/00

(52) U.S. Cl. ..... 345/98; 345/101; 345/35; 345/92; 345/103; 345/100; 345/88

(58) Field of Search ..... 345/101, 35, 92, 345/103, 100, 98, 88

(56) References Cited

U.S. PATENT DOCUMENTS 5,675,356 A * 10/1997 Ooki et al. ..... 345/101
5,889,566 A * 3/1999 Wu et al. ..... 349/35
5,923,311 A * 7/1999 Edwards ..... 345/92
5,990,859 A * 11/1999 Inoue et al. ..... 345/103
6,452,579 B1 * 9/2002 Itoh et al. ..... 345/100
6,498,596 B1 12/2002 Nakamura et al.
6,501,456 B1 * 12/2002 Saito et al. ..... 345/98
6,603,452 B1 * 8/2003 Serita ..... 345/88
6,606,080 B2 * 8/2003 Mukao ..... 345/98
6,747,625 B1 * 6/2004 Han et al. ..... 345/98

FOREIGN PATENT DOCUMENTS

JP 2001-306038 * 2/2001

OTHER PUBLICATIONS

U.S. Appl. No. 09/842,800, filed Apr. 27, 2001, Nakamura et al.
U.S. Appl. No. 09/945,826, filed Sep. 05, 2001, Nakamura.
U.S. Appl. No. 10/303,770, filed Nov. 26, 2002, Nakamura et al.

* cited by examiner

*Primary Examiner*—Chanh Nguyen
*Assistant Examiner*—Tammy Pham
(74) *Attorney, Agent, or Firm*—Oblon, Spivak, McClelland, Maier & Neustadt, P.C.

(57) ABSTRACT

A display apparatus, comprising: signal lines and scanning lines arranged vertically and horizontally; a plurality of display pixel parts connected to the signal lines and scanning lines; and a display control part which applies image data to the plurality of display pixel parts, wherein the display pixel part includes: a plurality of sub-display pixels which performs display in accordance with analog pixel data or digital pixel data applied to the corresponding signal line; and a plurality of one bit memories which store the digital pixel data applied to the corresponding signal line, wherein the display control part changes the order of the analog pixel data applied to the signal lines and the order of the digital pixel data applied to the signal lines to each other.

21 Claims, 24 Drawing Sheets

EQUIVALENT CIRCUIT OF ONE PIXEL(6-bit/Pix)

DATA ORDER A ANALOG WRITING

Ca, b:(b−bit)th OF SIGNAL LINE OF ath OF COLOR C (C=R, G, B, a=1~320, b=5~0)

| BUS NAME | R ODD | | | | B ODD, G EVEN, G ODD, R EVEN AND B EVEN CONTINUE IN THE SAME WAY |
|---|---|---|---|---|---|
| da5 | R1,5 | R3,5 | … | R159,5 | |
| da4 | R1,4 | R3,4 | … | R159,4 | |
| da3 | R1,3 | R3,3 | … | R159,3 | |
| da2 | R1,2 | R3,2 | … | R159,2 | |
| da1 | R1,1 | R3,1 | … | R159,1 | |
| da0 | R1,0 | R3,0 | … | R159,0 | |
| db5 | R319,5 | R317,5 | … | R161,5 | |
| db4 | R319,4 | R317,4 | … | R161,4 | |
| db3 | R319,3 | R317,3 | … | R161,3 | |
| db2 | R319,2 | R317,2 | … | R161,2 | |
| db1 | R319,1 | R317,1 | … | R161,1 | |
| db0 | R319,0 | R317,0 | … | R161,0 | |

DATA ORDER B DIGITAL WRITING

| BUS NAME | D5(MSBs) | | | | D4, D3, D2, D1 AND D0 CONTINUE IN THE SAME WAY |
|---|---|---|---|---|---|
| da5 | R1,5 | R3,5 | … | R159,5 | |
| da4 | G1,5 | G3,5 | … | G159,5 | |
| da3 | B1,5 | B3,5 | … | B159,5 | |
| da2 | R2,5 | R4,5 | … | R160,5 | |
| da1 | G2,5 | G4,5 | … | G160,5 | |
| da0 | B2,5 | B4,5 | … | B160,5 | |
| db5 | R320,5 | R318,5 | … | R162,5 | |
| db4 | G320,5 | G318,5 | … | G162,5 | |
| db3 | B320,5 | B318,5 | … | B162,5 | |
| db2 | R319,5 | R317,5 | … | R161,5 | |
| db1 | G319,5 | G317,5 | … | G161,5 | |
| db0 | B319,5 | B317,5 | … | B161,5 | |

FIG. 10

DISPLAY APPARATUS, DISPLAY SYSTEM AND METHOD OF DRIVING APPARATUS

CROSS REFERENCE TO RELATED APPLICATIONS

This application is based upon and claims the benefit of priority from the prior Japanese Patent Applications No. 2001-362175 filed on Nov. 28, 2001 and No. 2002-57701 filed on Mar. 4, 2002, the entire contents of which are incorporated herein by reference.

BACKGROUND OF THE INVENTION

1. Field of the Invention

The present invention relates to a liquid crystal display on which a drive circuit and a pixel part are integrally formed on a common insulating substrate. Especially, the present invention relates to the liquid crystal display in which a plurality of one bit memories are provided to store image data for each pixel.

2. Related Background Art

A display apparatus in which a memory is provided for each pixel to store image data has been proposed. For example, a display apparatus for holding the pixel voltage by a capacitor in the memory has been disclosed in Japanese Laid Open H9-258168. A display apparatus which holds data (voltage) for designating whether or not to turn on the pixel to the capacitor in the pixel, thereby continuing still image without driving the signal lines for a prescribed period is disclosed in Japanese Laid Open 2001-306038.

If the pixel data is stored in the memory, when the screen is not rewritten, it is possible to perform display by reading out data stored in the memory. Because of this, it is unnecessary to operate a latch circuit, a D/A converter, an analog buffer and so on in the signal drive circuit, thereby reducing power consumption.

However, if the memory is provided for each pixel, when moving image is displayed, contents of the memory has to be often updated, thereby increasing power consumption. Because the memory is formed below an opposite electrode and a pixel electrode, the capacitor in the memory causes a capacitance coupling between the opposite electrode and the pixel electrode. Therefore, a voltage at both ends of the capacitor is subjected to the influence of voltage fluctuation of the opposite electrode and the pixel electrode.

FIG. 28 is a diagram schematically showing positioning relationships between the opposite electrode COM and the pixel electrode Pix, and between the electrodes at both ends of the capacitor C composing of the memory. As shown in FIG. 28, when the potential of the opposite electrode fluctuates, the potential of the pixel electrode also fluctuates by the influence, and accordingly, the potential at the upper side electrode of the capacitor composing the memory also fluctuates.

When the potential at the upper electrode of the capacitor fluctuates, the logic held to the capacitor changes, thereby causing the change of color. That is, undesired problem such as irregular color may occur.

SUMMARY OF THE INVENTION

An object of the present invention is to provide a display apparatus capable of reducing power consumption.

In order to achieve the foregoing object, a display apparatus, comprising:

signal lines and scanning lines arranged vertically and horizontally;

a plurality of display pixel parts connected to said signal lines and scanning lines; and a display control part which applies image data to said plurality of display pixel parts, wherein said display pixel part includes:

a plurality of sub-display pixels which performs display in accordance with analog pixel data or digital pixel data applied to the corresponding signal line; and a plurality of one bit memories which store the digital pixel data applied to the corresponding signal line, wherein said display control part changes the order of the analog pixel data applied to the signal lines and the order of the digital pixel data applied to the signal lines to each other.

Further, a display apparatus according to the resent invention which comprises an array substrate having signal lines and scanning lines arranged vertically and horizontally, and a plurality of display pixel parts connected to the signal lines and scanning lines, wherein said display pixel part includes:

a plurality of sub-display pixels which perform display based on analog pixel data or digital pixel data applied to the corresponding signal line; and a one bit memory which stores the digital pixel data applied to the corresponding signal line, wherein said one bit memory includes:

a capacitor which charges electric charge in accordance with the digital pixel data; and a control transistor which switches whether or not to charge the electric charge to said capacitor, wherein said capacitor includes:

a first electrode connected to said control transistor; and a second electrode arranged opposite to said first electrode and connected to a ground line or a power supply line, said second electrode being formed above said first electrode and below pixel electrodes of said plurality of display pixel parts.

BRIEF DESCRIPTION OF THE DRAWINGS

FIG. 10 is a diagram comparing data writing order with analog writing and digital writing.

DESCRIPTION OF THE PREFERRED EMBODIMENTS

Hereinafter, a display apparatus according to the present invention will be more specifically described with reference to drawings.

Figure 1:
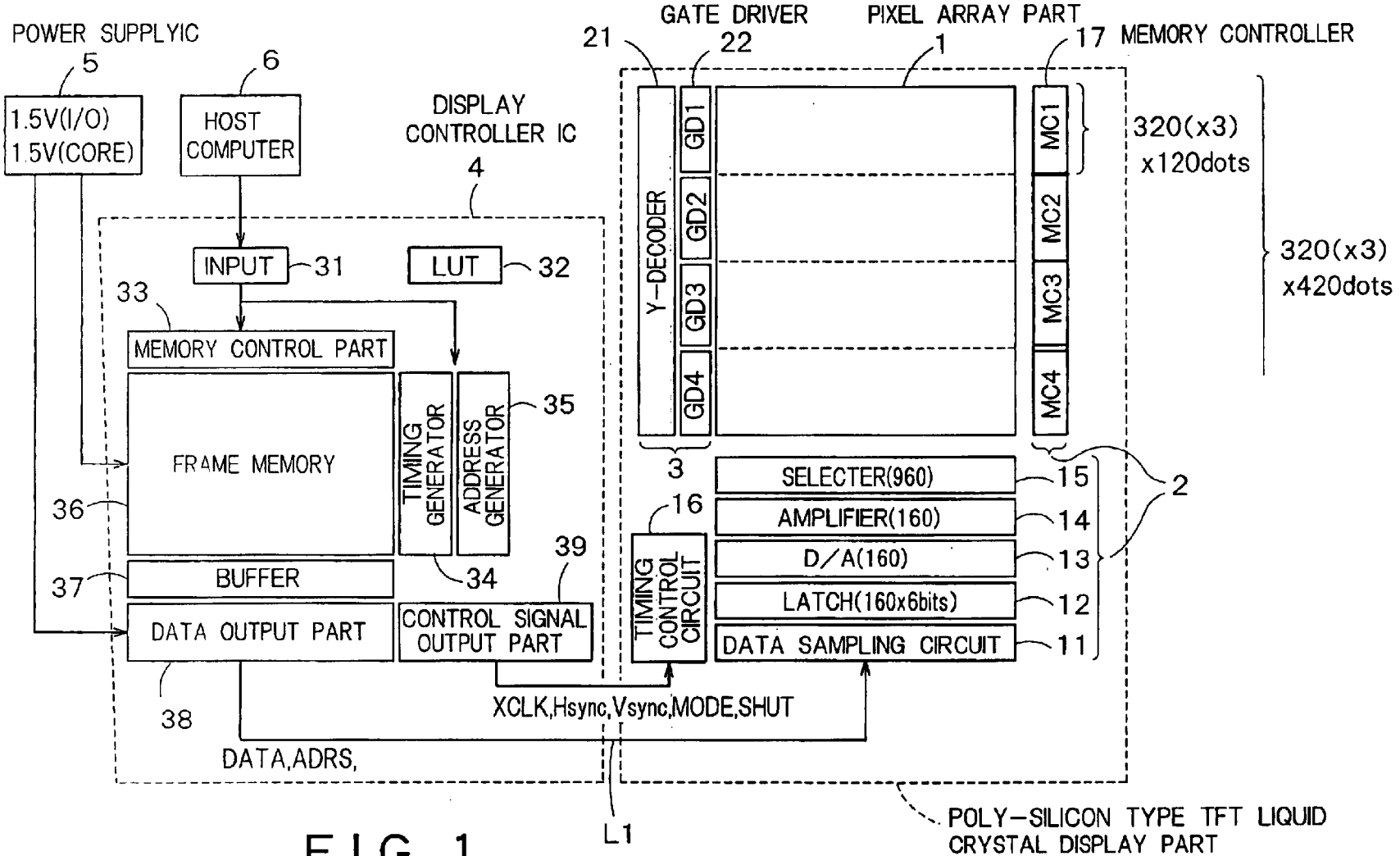
FIG. 1 is a diagram showing schematic configuration of a liquid crystal display according to a first embodiment of a display apparatus of the present invention.

FIG. 1 is a block diagram showing schematic configuration of a liquid crystal display according to a first embodiment of a display apparatus of the present invention. The liquid crystal display of FIG. 1 has a pixel array part 1 on which signal lines and scanning lines are arranged vertically and horizontally and a plurality of pixels are formed, a signal line drive circuit 2 for driving signal lines, a scanning drive circuit 3 for driving scanning lines, a display controller IC 4, a power supply IC 5, and so on. The liquid crystal display of FIG. 1 displays pixel data applied from a host computer 6.

A liquid crystal display part 7 consisted of the pixel array part 1, the signal line drive circuit 2 and the scanning line drive circuit 3 is formed of, for example, poly-silicon TFTs formed on an insulating substrate. The display controller IC 4 and the power supply IC 5 are implemented on a common insulating substrate by COG (Chip On Glass). The circuits embedded in the display controller IC 4 may be formed of the poly-silicon TFT on the insulating substrate.

The signal line drive circuit 2 has a data sampling circuit 11 for sampling the pixel data applied from the display controller IC 4 via a video bus L1, a latch circuit 12 for latching data sampled by the data sampling circuit 11, a D/A converter (D/A) 13 for converting the latched data into an analog voltage, an amplifier 14 for amplifying the output of the D/A 13, a selector 15 for distributing the output of the amplifier 14 to the signal lines, a timing control circuit 16 for controlling timing of each part in the signal line drive circuit 2, and a memory controller 17 for controlling data writing for the pixel array part 1.

The scanning line driving circuit 3 has a Y-decoder 21 and four gate drivers 22. In the pixel array part 1, for example, the number of total pixels is 320(×3)×480, the display area is divided into four above and below, and each block has 320(×3)×120 pixels. The scanning lines of each block are driven by the corresponding gate driver 22.

The display controller IC4 has an input part 31, a lookup table (LUT) 32, a memory control part 33, a timing generator 34, an address generator 35, a frame memory 36, a buffer 37, a data output part 38 and a control signal output part 39.

The power supply IC 5 embeds a DC/DC converter, an opposite electrode drive circuit and so on. The power supply IC5 is supplied with the driving voltage VDD of 3V and the ground voltage VSS from an external power supply not shown.

Figure 2:
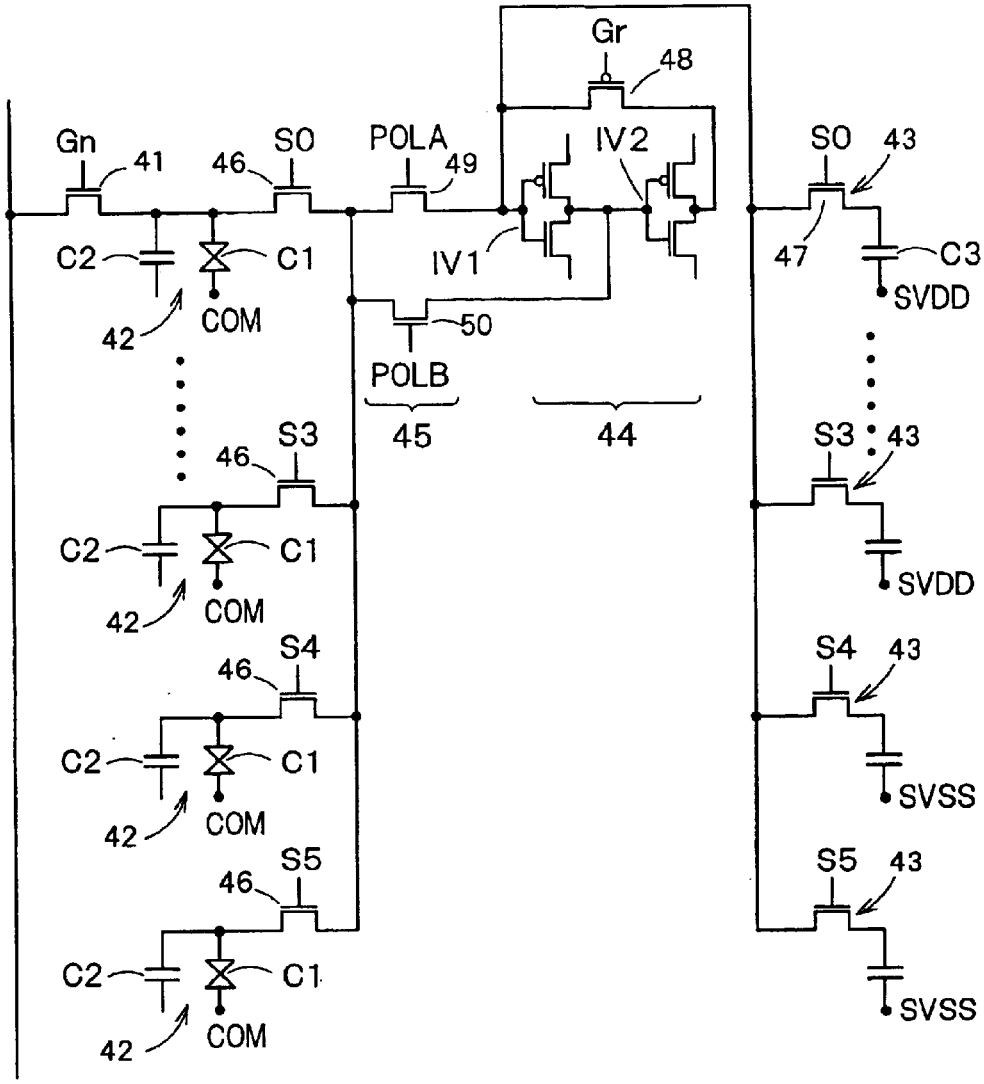
FIG. 2 is a circuit diagram showing a detailed configuration of one display pixel of a pixel array part.

FIG. 2 is a circuit diagram showing schematic configuration of one display pixel in the pixel array part 1. As shown in FIG. 2, one display pixel includes a pixel TFT 41 connected to the signal line, six sub-display pixel parts 42, six one-bit memories (DRAM) 43, a refresh circuit 44 for refreshing these DRAMs 43, and a polarity inversion circuit 45 connected between the sub-display pixel parts 42 and the refresh circuit 44.

Area ratio of the respective sub-display pixel parts 42 is 32:16:8:4:2:1. Thus, the gradation display of $2^6$=64 is realized by providing six sub-display pixel parts 42 each having the different area.

A liquid crystal layer is sealed between the sub-display pixel part 42 and the opposite electrode to form a liquid crystal capacitor C1. Because the liquid crystal as material of the liquid crystal layer requires no high-speed response, a normal TN liquid crystal may be used as the material. Each of the sub-display pixel parts 42 has an auxiliary capacitor C2 and a transferring TFT 46.

Each of the DRAMs 43 has a read/write control transistor 47 and a capacitor C3. The refresh circuit 44 has two inverters IV1 connected in series, and a feedback TFT 48 connected between an input terminal of an inverter IV1 at initial stage and an output terminal of an inverter IV2 at subsequent stage. The output terminal of the inverter IV1 at initial stage and the input terminal of the inverter IV2 at subsequent stage are connected to a polarity inversion circuit 45. The refresh circuit 44 refreshes data stored in the DRAM 43 by using the power supply voltage Vdd (5V) and the ground voltage Vss (0V).

The polarity inversion circuit 45 has selecting transistors 49 and 50 for selecting either of the outputs of the inverters IV1 and IV2 in the refresh circuit 44. These selecting transistors 49 and 50 are controlled to ON/OFF based on the polarity control signals SPOLA and SPOLB from the memory controller 17 of FIG. 1.

The liquid crystal display of the present embodiment can realize display of $2^6$=64 gradations by area gradation method. It is possible to switch the display based on analog pixel data and the display based on digital pixel data. More specifically, the liquid crystal display of the present embodiment performs display based on the analog pixel data during moving image display period, and performs display based on digital pixel data during still image display period.

Hereinafter, the writing based on the analog pixel data is called analog writing, and the writing based on the digital pixel data is called digital writing.

The display controller IC 4 determines whether to perform the analog writing or the digital writing. The digital controller IC 4 monitors the writing from a host computer 6 to the frame memory 36. If the contents of the frame memory 36 do not change for a prescribed period, it is determined to be the still image display, and the digital writing is performed for the next one frame. After then, data output from the display controller IC 4 is stopped. When the contents of the frame memory 36 changes, data output from the display controller IC 4 is again begun from subsequent frame to perform the analog writing.

When the still image is displayed, the display is updated based on data stored in the DRAM 43 of each pixel. Because of this, it is unnecessary to drive a peripheral circuit such as the signal line drive circuit 2 and so on, thereby reducing power consumption.

In the conventional liquid crystal display, even if the image data D/A 13 is not inputted to the display controller IC 4, the display controller IC 4 has always outputted the pixel data for one frame. On the other hand, according to the present embodiment, because each pixel embeds the memory, the output of all the image data from the display controller IC 4 is stopped, and even if the operation of the signal line drive circuit 2 is stopped, it is possible to continue the display.

The liquid crystal display according to the present embodiment can perform the analog writing with regard to only a portion of the display screen, and can perform the digital writing with regard to the other area. Alternatively, it is possible to continue the display by only the polarity inversion operation of the pixel electrode based on data stored in the DRAM 43 in each pixel. Accordingly, it is possible to partially rewrite the display screen. Therefore, it is unnecessary to drive the signal line drive circuit and so on in vain, thereby further reducing power consumption.

Figure 3:
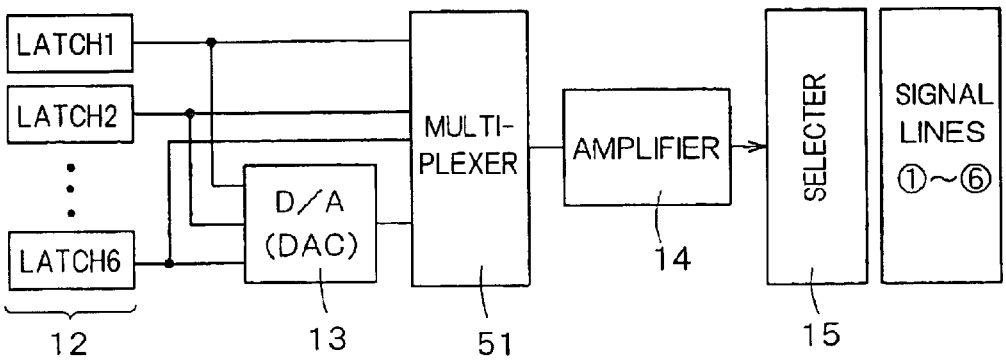
FIG. 3 is a diagram showing connection relationship of a latch circuit and a D/A.

In the present embodiment, the operation of the signal line drive circuit 2 is different from the analog writing and the digital writing. FIG. 3 is a diagram showing a detailed connection relationship of the latch circuit 12 and the D/A (DAC) 13. The circuit of FIG. 3 is practically provided 160 pieces.

During the analog writing period, the digital pixel data of 6 bits applied to one signal line is latched by six latch circuits 12, respectively. The D/A 13 converts 6 bits the data latched by the six latch circuits 12 into the analog pixel voltages. The multiplexer 51 arranged at subsequent stage of the D/A 13 supplies the analog pixel voltage outputted from the D/A 13 to the amplifier 14. The amplifier 14 performs current amplification of the analog pixel voltage from the D/A 13, and supplies the analog pixel voltage to the corresponding signal line. The selector is realized by known analog switches.

On the other hand, during the digital writing period, certain bits among six types of the digital pixel data supplied to six signal lines, for example, initially most significant bit, are latched by six latch circuits 12, respectively. The multiplexer 51 supplies six types of data latched by six latch circuits 12 to the amplifier 14 by selecting for every one type. The selector 15 supplies the output of the amplifier 14 to the corresponding signal line. This operation is repeated in order. By performing such an operation, it is unnecessary to provide the additional latch circuit.

Figures 4A, 4B:
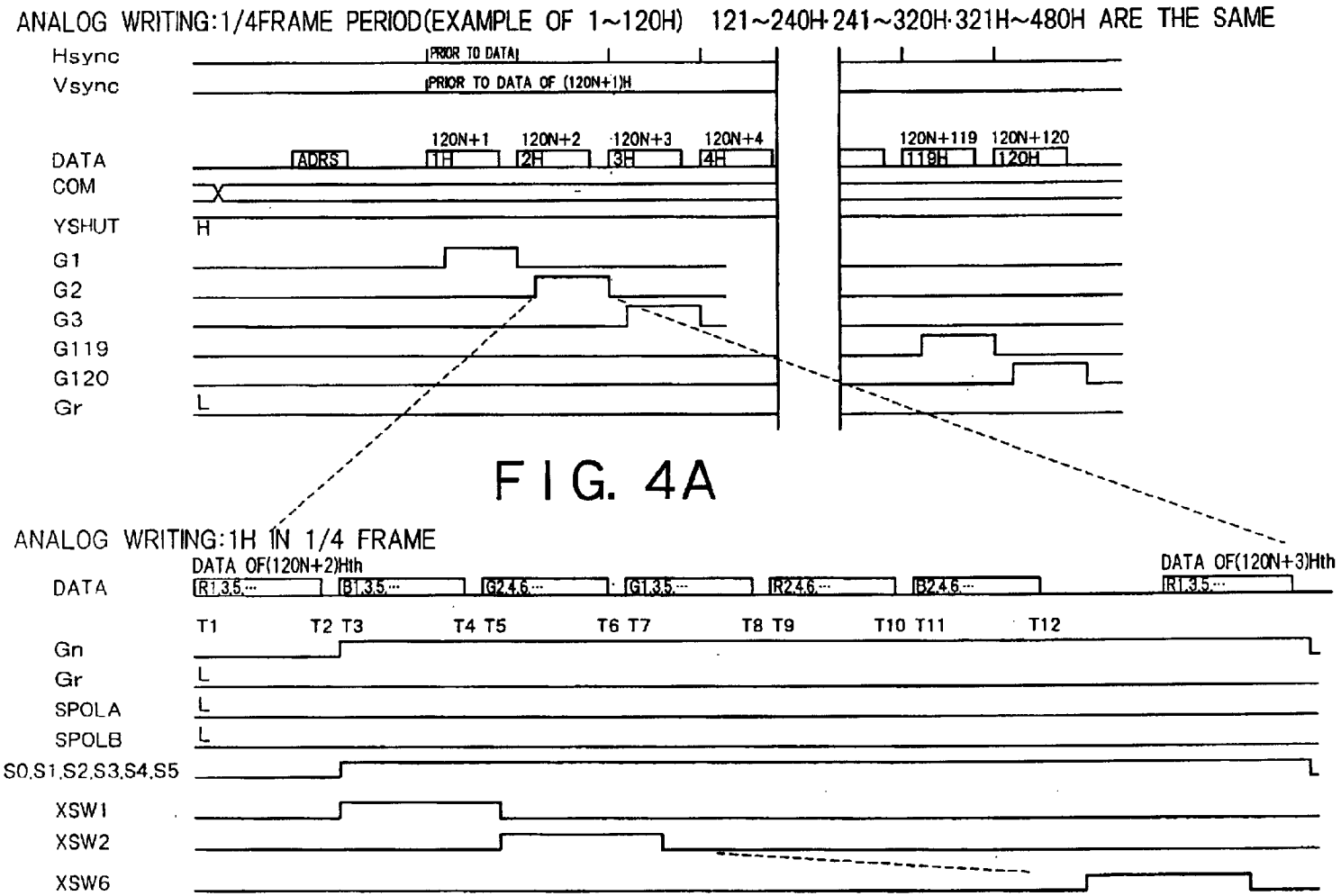
FIG. 4 is a timing chart during analog writing period.

Next, the operation of the liquid crystal display of FIG. 1 will be described hereinafter. FIGS. 4A and 4B are timing chart during the analog writing, and FIG. 5 is a diagram explaining the operation of the liquid crystal display during the analog writing display period.

Figure 5:
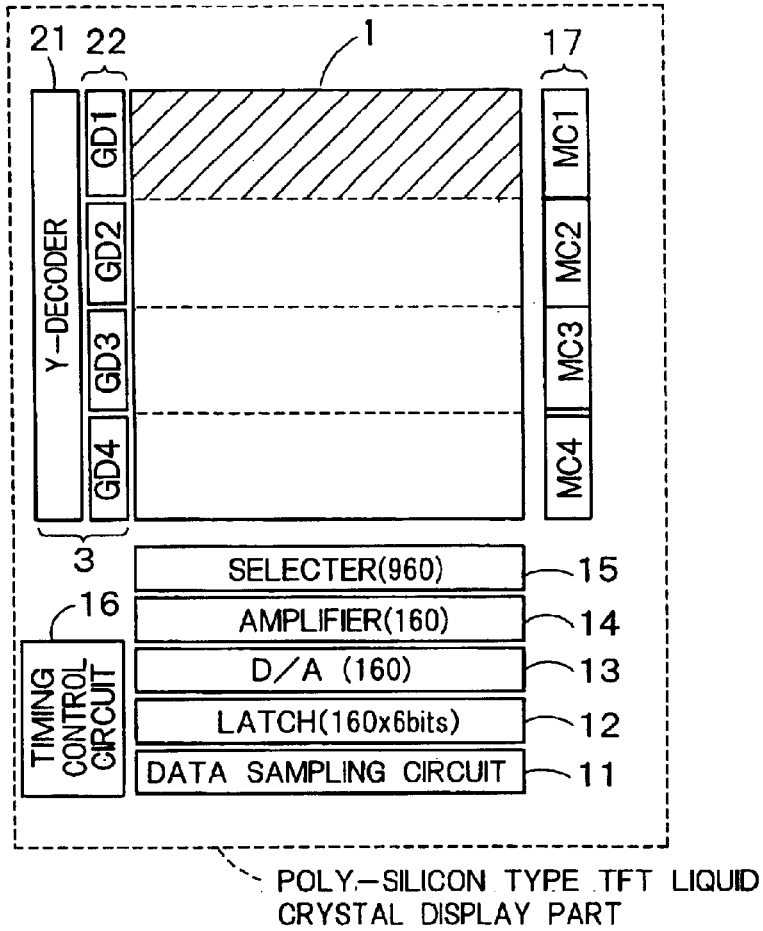
FIG. 5 is a diagram explaining operation of a liquid crystal display during analog writing period.

FIG. 4A shows the operational timing of ¼frame period expressed by a hatched line of FIG. 5. As shown in FIG. 4A, the writing is performed in order by each horizontal line. FIG. 4B shows detailed writing timing of the second horizontal line (2H).

During the analog writing period, as shown in FIG. 4B, the writing is performed in order of (1) odd pixel data for one horizontal line of red color (time T1–T2), (2) odd pixel data for one horizontal line of blue color (time T3–T4), (3) even pixel data for one horizontal line of green color (time T5–T6), (4) odd pixel data for one horizontal line of green color (time T7–T8), (5) even pixel data for one horizontal line of red color (time T9–T10), and (6) even pixel data for one horizontal line of blue color (time T11–T12).

When the writing of (1)–(6) is finished, the same processings are repeated with regard to the next horizontal line.

When the analog writing is performed, two selecting transistors 49 and 50 in the polarity inversion circuit 45 of FIG. 2 are set to be OFF. Accordingly, data is not written to the DRAM 43. When the analog writing is performed, the signals S0–S5 of FIG. 2 are always set to be high level, and all the transferring TFTs 46 are set to be ON. At this state, when the analog pixel data of (1)–(6) are applied in order, the electric charge in accordance with the analog pixel voltage is charged to all the liquid crystal capacitor C1 and the auxiliary capacitor C2, thereby realizing 64 gradations for each color.

Figure 6:
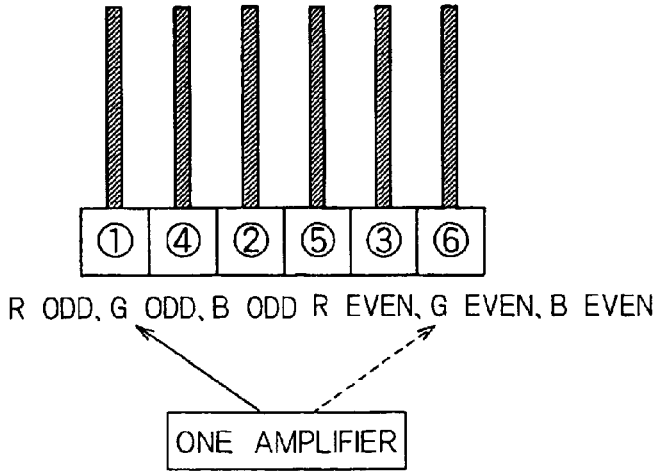
FIG. 6 is a diagram showing a signal type applied to signal lines during analog writing period.

As shown in FIG. 3, the liquid crystal display of the present embodiment has the D/A 13 and the amplifier 14 for every six signal lines. Accordingly, during the analog writing period, the selector 15 at subsequent stage of the amplifier 14 switches the selection in order of (1)–(6) of FIG. 6. The timing of the signals XSW1–XSW6 for switching the selection of the selector 15 is shown in FIG. 4B.

Thus, by providing the selector 15 to subsequent stage of the amplifier 14, it is possible to share the amplifier 14 and the D/A 13 by a plurality of signal lines, thereby reducing the circuit volume and power consumption. Although the example in which the signal lines driven at the same time are divided into six groups by the colors of RGB and even/odd has been described, the present invention is not been limited to the above-mentioned example. The signal lines may be divided into twelve groups of 12×N+1, 12×N+2, . . . , 12×N+12 (N=0, 1, . . . ). That is, various modifications are possible.

Figure 7A:
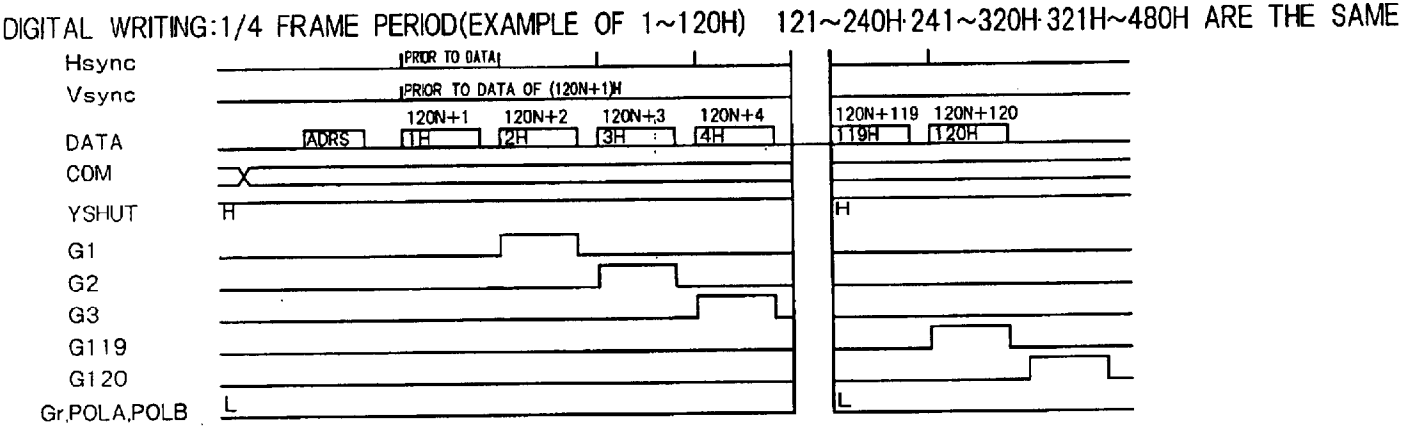
FIG. 7 is a timing chart during digital writing period.
Figure 7B:
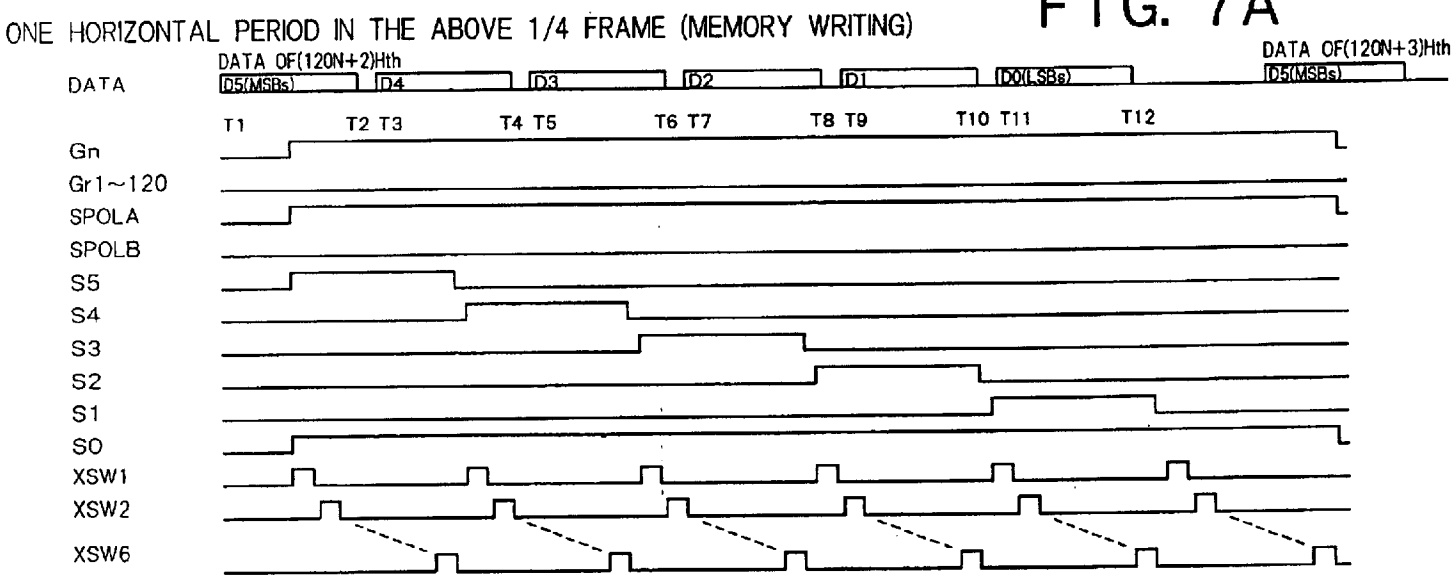
Figure 8:
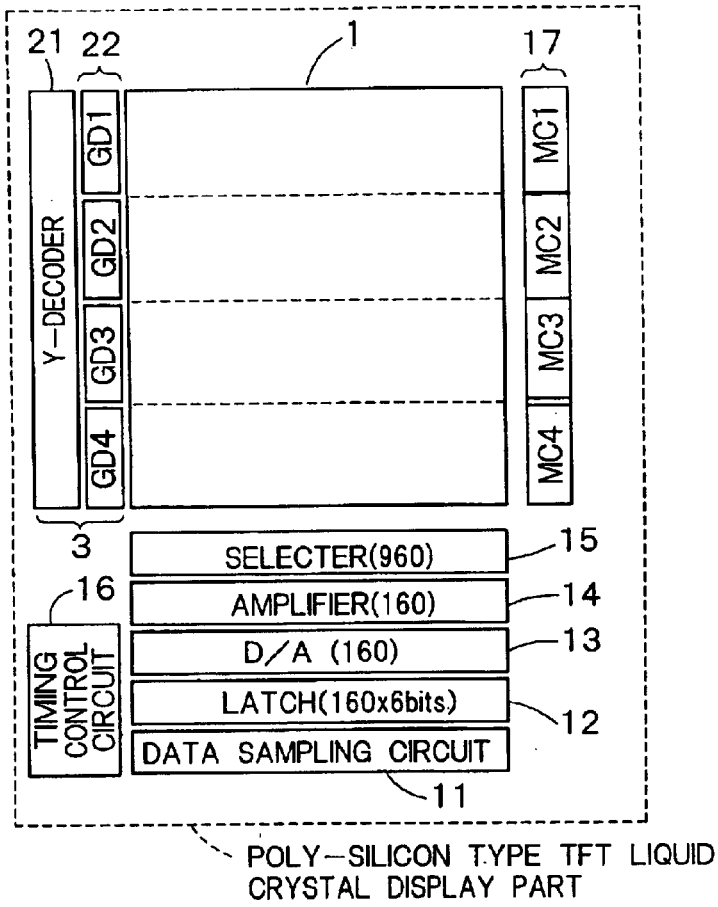
FIG. 8 is a diagram explaining operation of a liquid crystal display during digital writing period.

Next, the digital writing will be described. FIGS. 7A and 7B are timing charts during the digital writing period, and FIG. 8 is a diagram explaining the liquid crystal display during the digital writing period.

FIG. 7A shows the timing of ¼frame period, and the writing timing of one horizontal line is shown in FIG. 7B.

During the digital writing period, as shown in FIG. 7B, the writing is performed in order of (1) the most significant bit D5 of all the pixel data for one horizontal line (time T1–T2), (2) a bit D4 of all the pixel data for one horizontal line (time T3–T4), (3) bit D3 of all the pixel data for one horizontal line (time T5–T6), (4) bit D2 of all the pixel data for one horizontal line (time T7–T8), (5) bit D1 of all the pixel data for one horizontal line (time T9–T10), and (6) bit D0 of all the pixel data for one horizontal line (time T11–T12).

Figure 9:
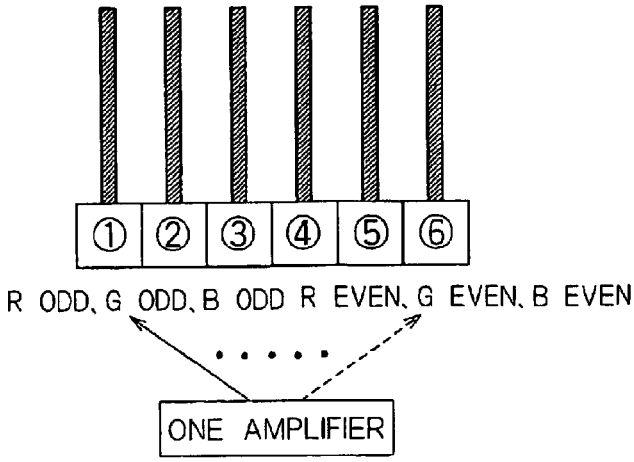
FIG. 9 is a diagram showing signal type applied to signal lines during digital writing period.

In the above-mentioned (1)–(6), as shown in FIG. 9, the writing is performed in order of the odd pixels of red color, the odd pixels of green color, the odd pixels of blue color, the even pixels of red color, the even pixels of green color and the even pixels of blue color.

During the digital writing period, as shown in FIG. 7B, because the signal S0 is always set to be high level, the transferring TFT 46 is always set to be ON state. At this state, the signals S5–S1 are set to be ON in order.

First, the signal S5 is set to be ON. Therefore, the transferring TFT 46 to which the signals S0 and S5 are inputted and the read/write control transistor 47 in the DRAM 43 to which the signals S0 and S5 are inputted turns on. At this time, the most significant bit data D5 of the red odd pixel data is applied to the signal lines, the data is stored into the corresponding DRAM 43, and the corresponding electric charge is stored into the liquid crystal capacitor C1 of the corresponding sub-display pixel.

Subsequently, the signal S5 is maintained to be ON, and the most significant bit data D5 of the green color odd pixel data is applied to the adjacent signal line. Therefore, the data is stored into the DRAM 43 corresponding to the signal line, and the corresponding electric charge is charged to the liquid crystal capacitor C1 of the corresponding sub-display pixel.

Similarly, at the state that the signal S5 is maintained to be ON, the most significant bit data D5 of each data of blue color odd pixels, red color even pixels, green color even pixels and blue odd pixels are applied to the corresponding signal line in order.

Next, instead of the signal S5, the signal S4 is set to be ON. Therefore, the transferring TFT 46 to which the signals S0 and S4 are inputted, and the read/write control transistor 47 in the DRAM 43 to which the signals S0 and S4 are inputted, turn on. At this time, the bit data D4 of the red color odd pixel data is applied to the signal line. The data is stored into the corresponding DRAM 43, and the corresponding electric charge is charged to the corresponding liquid crystal capacitor C1.

Subsequently, the signal S4 is maintained to be ON, and the bit data D4 of each data of green color odd pixels, blue color odd pixels, red color even pixels, green color even pixels and blue color even pixels is applied to the corresponding signal line in order.

Next, similarly, the signals S3–S1 are set to be ON in order, and the bit data D3–D1 of the pixel data is written in order.

Next, only the signal S0 is set to be ON, and the least significant bit data D0 is written to the DRAM 43 to which the signal S0 is inputted, and the corresponding electric charge is charged to the liquid crystal capacitor C1.

As described above, the present embodiment changes the writing order of the pixel data in the cases of the analog writing and the digital writing. The reason is why if the digital writing is performed at the same writing sequence as that of the analog writing, the transferring TFT has to be often turned on/off, thereby increasing power consumption. On the other hand, if the digital writing is performed by the above-mentioned method, all colors are written in sequence with regard to a certain bit of the digital pixel data, and during writing the certain bit, it is unnecessary to allow the transferring TFT to turn ON or OFF. Because of this, it is possible to decrease the number of times that the transferring TFT is turned on/off, thereby reducing power consumption.

FIG. 10 is a diagram summarizing the data writing order at the analog writing and the digital writing. In FIG. 10, data written at the same timing is shown in horizontal direction, and data written at the different timing is shown in vertical direction. For example, R1, 5 expresses fifth bit of the first signal line of red color.

Figure 11:
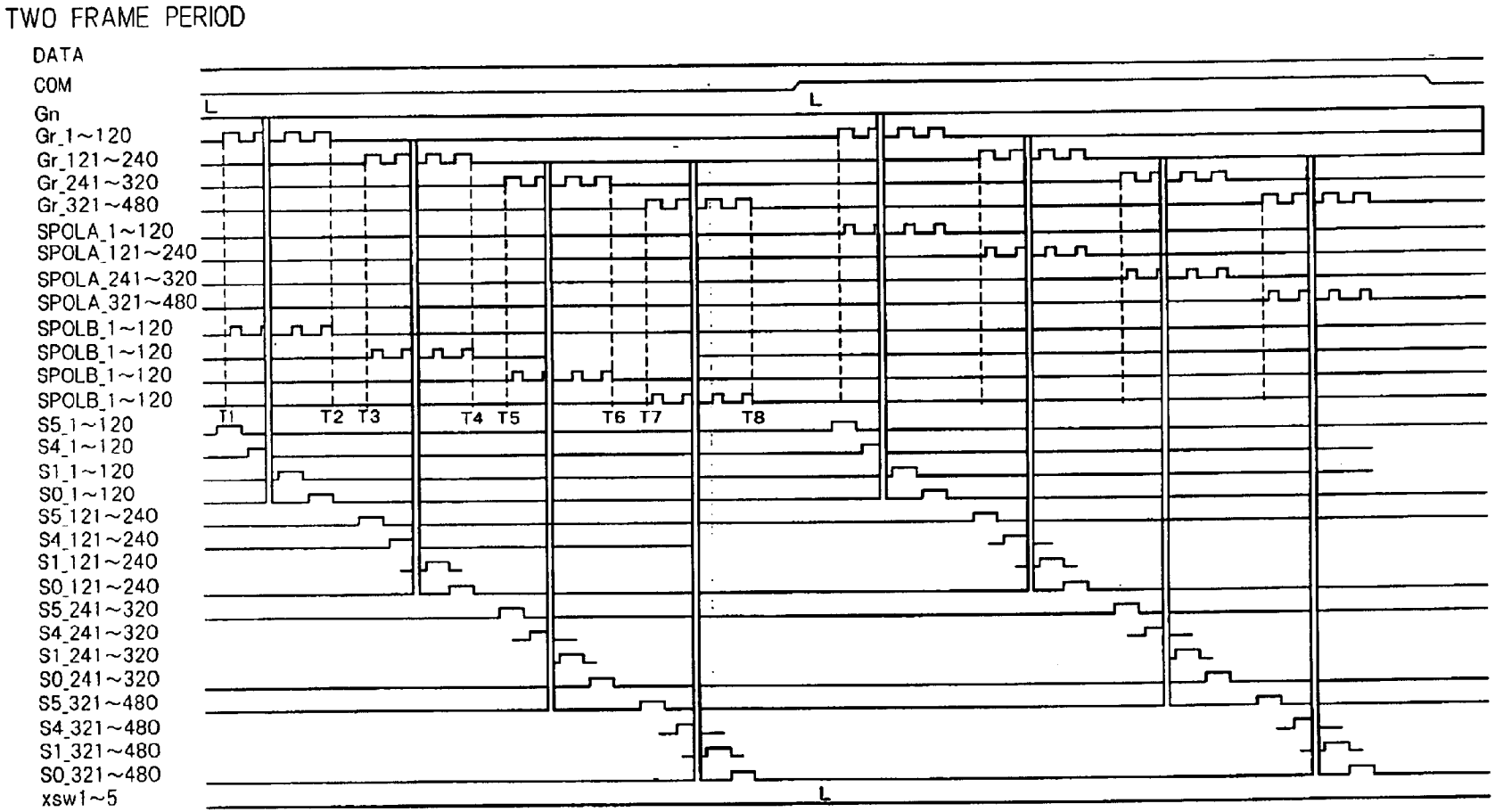
FIG. 11 is a timing chart during still image display period.

Next, the holding display of data stored in the DRAM 43, that is, the still image display will be described hereinafter. FIG. 11 is a timing chart during the still image display period, and FIG. 12 is a diagram explaining operation of the liquid crystal display during the still image display period.

Figure 12:
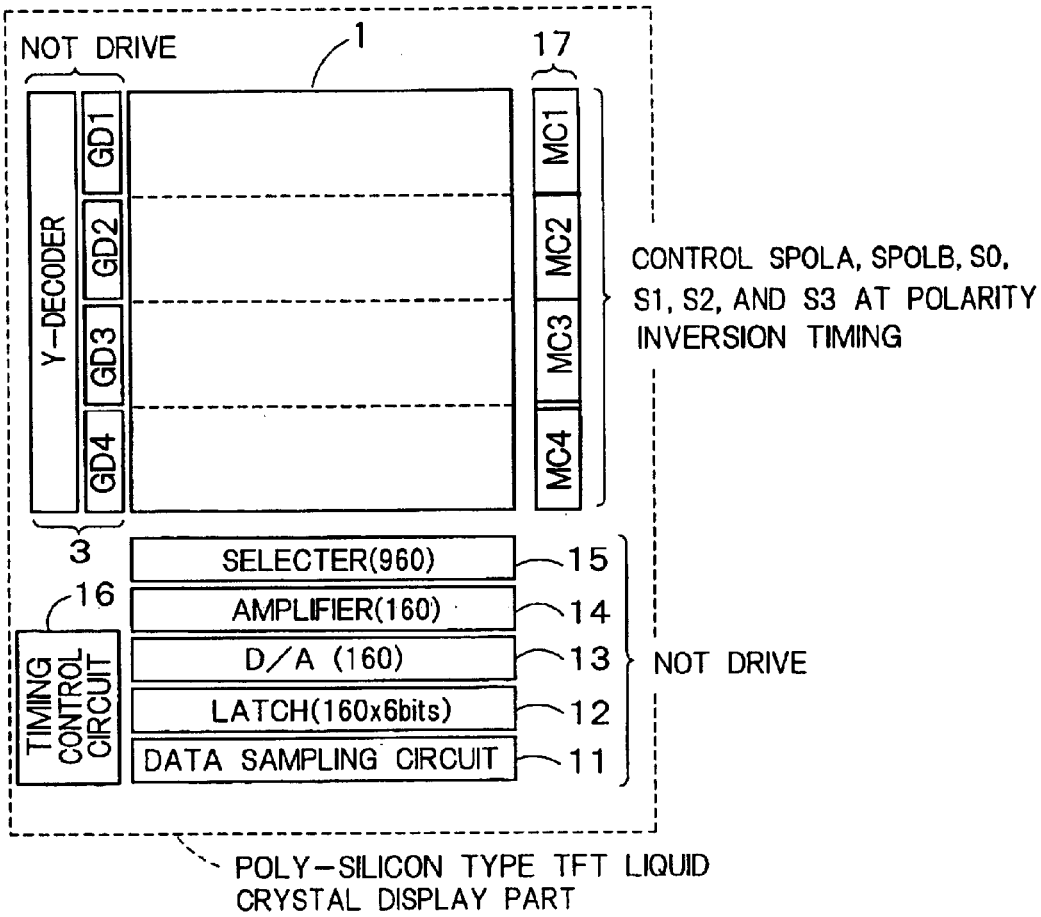
FIG. 12 is a diagram explaining operation of a liquid crystal display during still image display period.

During the still image display period, as shown in FIG. 12, a portion of the signal line drive circuit 2, more specifically, the data sampling circuit 11, the latch circuit 12, the D/A 13, the amplifier 14 and the selector 15 do not operate. During the still image display period, as shown in FIG. 11, the signals S5–S0 becomes high for each constant period in order, respectively. When the signals S5–S0 are high level, the refresh circuit 44 operates to perform refresh operation.

The operation of the liquid crystal display during the still image display period will be more specifically described with reference to FIG. 2. At the state in which the signal S5 is set to be high level, data of the DRAM 43 corresponding to the signal line is led to the refresh circuit 44. When the signal Gr becomes high, two inverters IV1 and IV2 are connected on loop shape to refresh the DRAM 43. Either of two transistors 49 and 50 composing the polarity inversion circuit 45 turns on, and the electric charge in accordance with data stored in the DRAM 43 or the inversion data is charged to the liquid crystal capacitor C1 corresponding to the signal S5.

Next, at state that the signal S4 is set to high level, data of the DRAM 43 is led to the refresh circuit 44. When the signal Gr becomes high level, the inverters IV1 and IV2 are connected on the loop to refresh the DRAM 43. Either of two transistors composing the polarity inversion circuit 45 turns on, and the electric charge in accordance with data stored in the DRAM or the inversion data is charged to the liquid crystal capacitor C1 corresponding to the signal S4.

By repeating the same operation with regard to the signals S3, S2, S1 and S0 in order, the polarity inversion of all the liquid crystal capacitors is finished.

The still image display is performed for each pixel block obtained by dividing the display screen into four backwards and forwards. More specifically, as shown in FIG. 11, the still image display of 1–120 lines is performed at time T1–T2, the still image display of 121–240 lines is performed at time T3–T4, the still image display of 241–360 lines is performed at time T5–T6, and the still image display of 361–480 lines is performed at time T7–T8 in order.

After then, at next frame, the common voltage is inverted, and then the same processings are performed.

Thus, during the still image display period, because data stored in the DRAM 43 is read out to perform display processings. It is unnecessary to operate the data sampling circuit 11, the latch circuit 12, the D/A 13, the amplifier 14 and the selector 15 in vain, thereby reducing power consumption.

Figure 13:
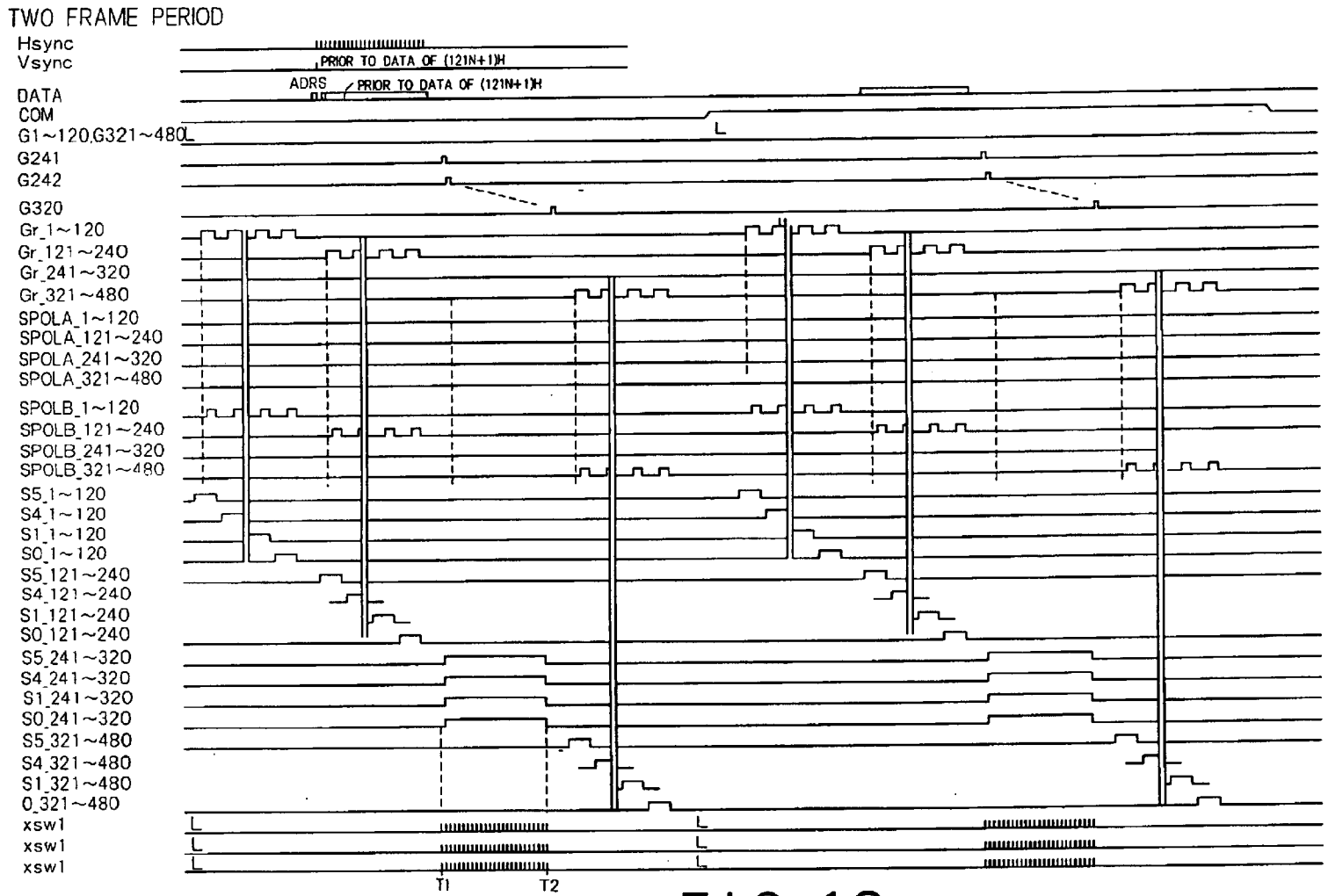
FIG. 13 is a timing chart in the case of performing analog writing with regard to only a partial area of a display screen.
Figure 14:
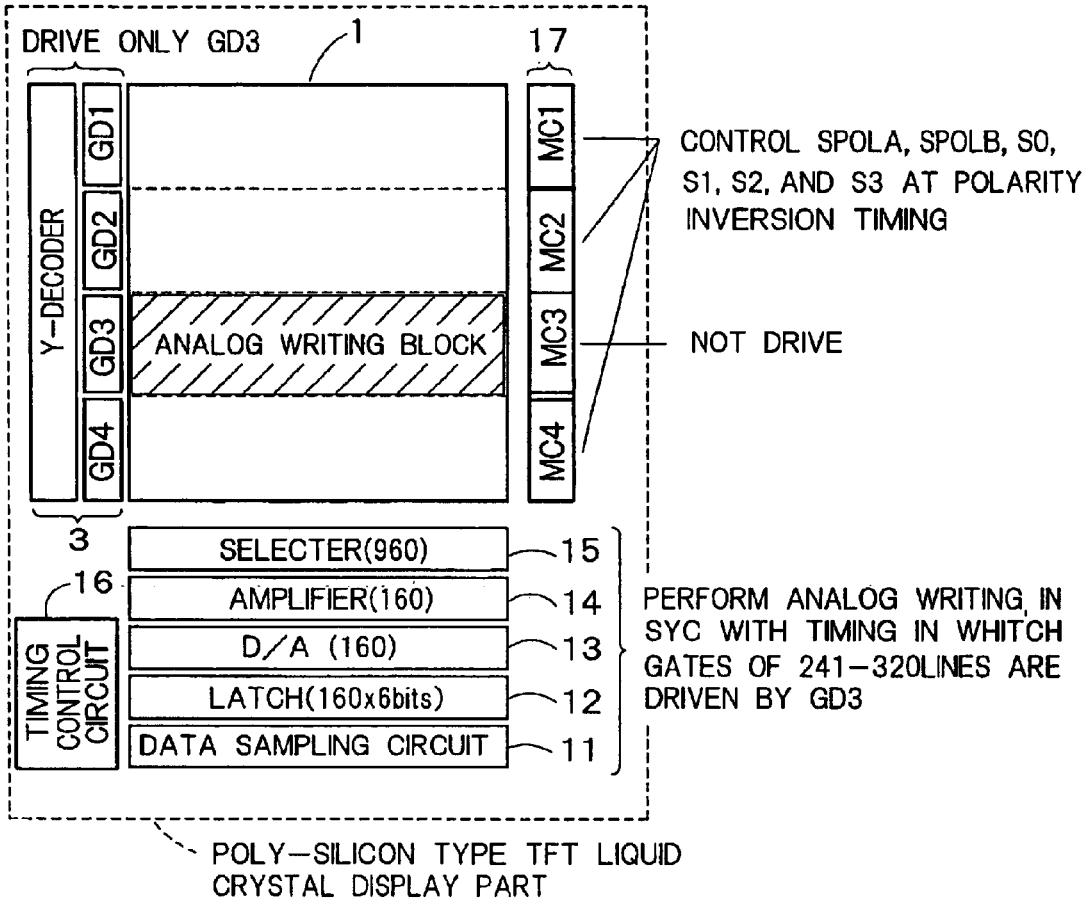
FIG. 14 is a diagram explaining operation of a liquid crystal display in the case of performing analog writing with regard to only a partial area.

Next, an example of performing the analog writing with regard to only a partial area of the display screen will be described. FIG. 13 is a timing chart in this case, and FIG. 14 is a diagram explaining operation of the liquid crystal display in the case of performing the analog writing with regard to only the partial area. FIG. 13 shows an example of performing the analog writing with regard to only the 241–320 lines as shown in a hatched part of FIG. 14 and performing the polarity inversion operation by reading out the contents of the DRAM 43 with regard to the other area.

In this case, the analog writing is performed in sync with the timing that the scanning line drive circuit 3 drives the gates of the pixel TFTs 41 of 241–320 lines at time T1–T2 of FIG. 13. In the other period, similarly to the still image display, data stored in the DRAM 43 is read out in units of 120 lines in order to rewrite the data read out by the DRAM 43 to the liquid crystal capacitor C1.

Thus, according to the present embodiment, it is possible to alternatively perform the analog writing and the digital writing, to perform the analog writing with regard to only a portion of the display screen and to perform the digital writing with regard to the other area of the display screen. Because of this, it is unnecessary to operate the D/A 13 and so no in the signal line drive circuit 2 in vain, thereby reducing power consumption.

The present embodiment performs a so-called common inversion drive. When DC voltage continues to be applied to liquid material, particles (molecules) gradually breakdown. As a result, it is known to cause display defect such as contrast irregularity or image sticking. As this countermeasure, it is necessary to invert polarity of a voltage applied to the liquid crystal layer at a prescribed cycle, and V line inversion drive and common inversion drive are well used.

The V line inversion drive fixes the common electrode to 5V, and alternatively applies to the signal lines the positive polarity voltage of 5.5–9.5V and the negative polarity voltage of 4.5–0.5V. The V line inversion drive is a drive method of alternatively changing the positive polarity and the negative polarity for each signal line.

The common inverting drive drives the common electrode to 0V or 5V at a prescribed cycle, and a voltage applied to the signal line is set to be 0.5–4.5V. In the liquid crystal display for portable telephones and the display for portable information terminals such as a PDA, common inverting driving is favorable because required voltage range for signal line is smaller. The common inversion drive is an example, if the voltage range applied to the signal lines is small, the other drive method may be adopted. The reason is why the reduction of power consumption of the signal line drive circuit is effective in order to extend charging cycle of the battery.

(Second Embodiment)

A second embodiment has a feature in which the voltage at both ends of the capacitor composing the DRAM 43 is not affected on fluctuation of the voltage of the pixel electrode and the common voltage.

Figure 15:
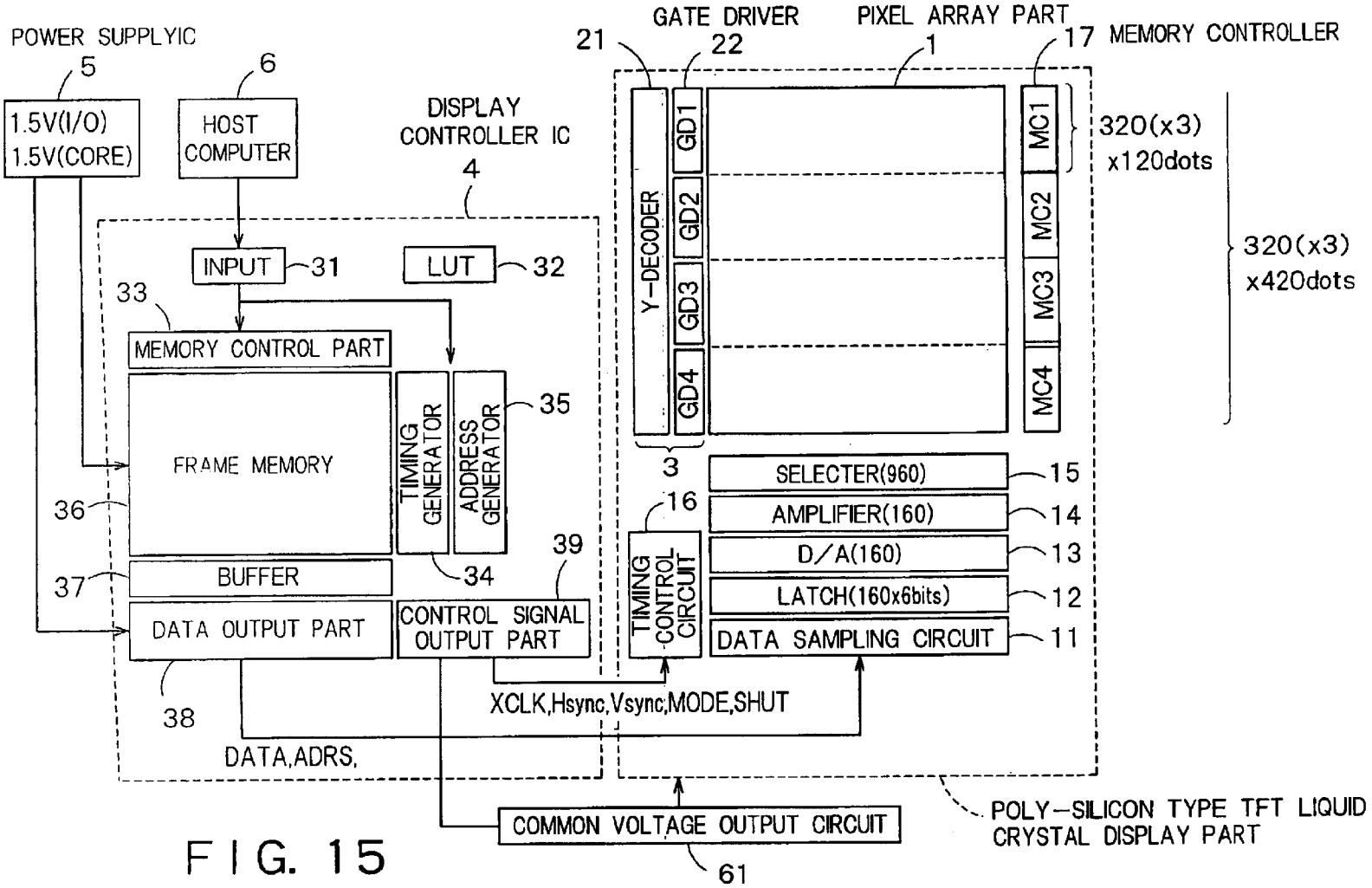
FIG. 15 is a block diagram showing schematic configuration of a display apparatus of the present invention.

FIG. 15 is a block diagram showing schematic configuration of a display apparatus according to the present invention. In FIG. 15, the same reference numbers are attached to configurations common to those of FIG. 1. Hereinafter, different points will be mainly described.

The liquid crystal display of FIG. 15 has a common voltage output circuit 61 for performing waveform shaping of the common voltage in addition to configuration of FIG. 1. The common voltage output circuit 61 is embedded in an IC separate from the liquid crystal part 6 and the display controller IC 4.

Figure 16:
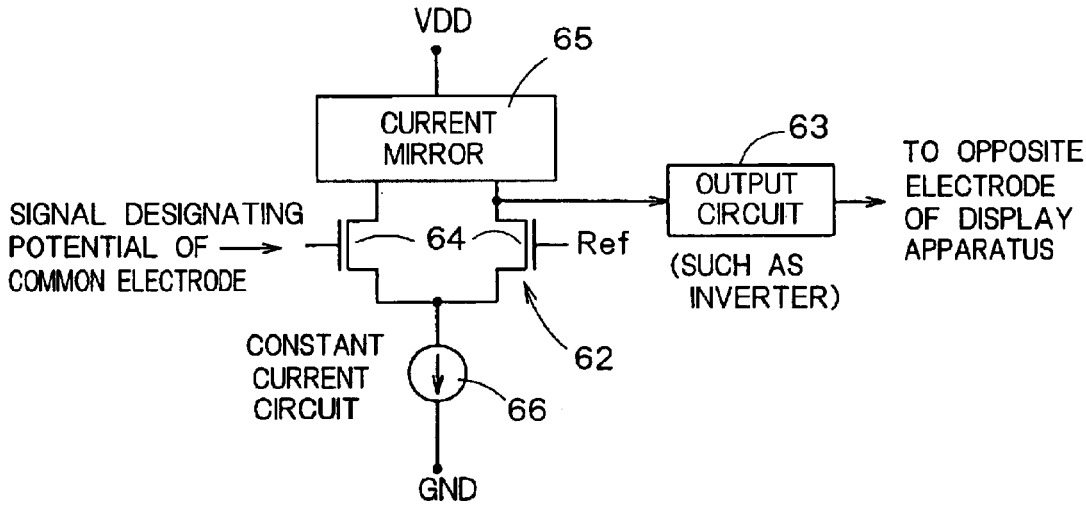
FIG. 16 is a circuit diagram showing schematic configuration of a common voltage output circuit.

FIG. 16 is a circuit diagram showing a detailed configuration of the common voltage output circuit 61. As shown in FIG. 16, the common voltage output circuit 61 has an operational amplifier 62 which outputs a signal designating common potential supplied from the display controller IC 4 and common electrode driving waveform in accordance with a reference voltage Ref for adjusting a rising speed of a common electrode drive waveform applied to the common electrode and an output circuit 63. The operational amplifier 62 has a transistor pair 64, a current mirror circuit 65 and a constant current circuit 66.

The constant current circuit 66 variably adjusts the current based on the bias signal applied from the display controller IC 4. More specifically, in the case of performing the analog writing of the entire screen, the current flowing through the constant current circuit 66 is increased. Therefore, the common voltage waveform becomes sharp. In the case of performing holding display based on the contents of the DRAM 43, the current flowing through the constant current circuit 66 is decreased. Therefore, the common voltage waveform is rounded.

Figure 30:
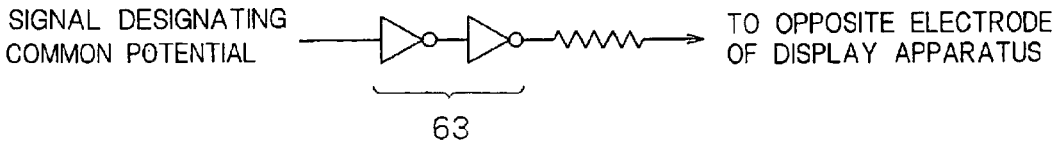
FIG. 30 is a diagram explaining a method of inserting a resistor at subsequent stage of an output circuit.

As the other method for rounding the common voltage waveform, without using the operational amplifier 62, as shown in FIG. 30, it is possible to insert a resistor at subsequent stage of the output circuit 63. In the case of small type liquid crystal display for the portable telephone having about 2 inch of diagonal length, if the frame frequency, which is a cycle for performing data writing for one frame, is 60 Hz, it is desirable to set a product between the resistor and the common capacitor of the liquid crystal cell to be some msec.

Figure 17:
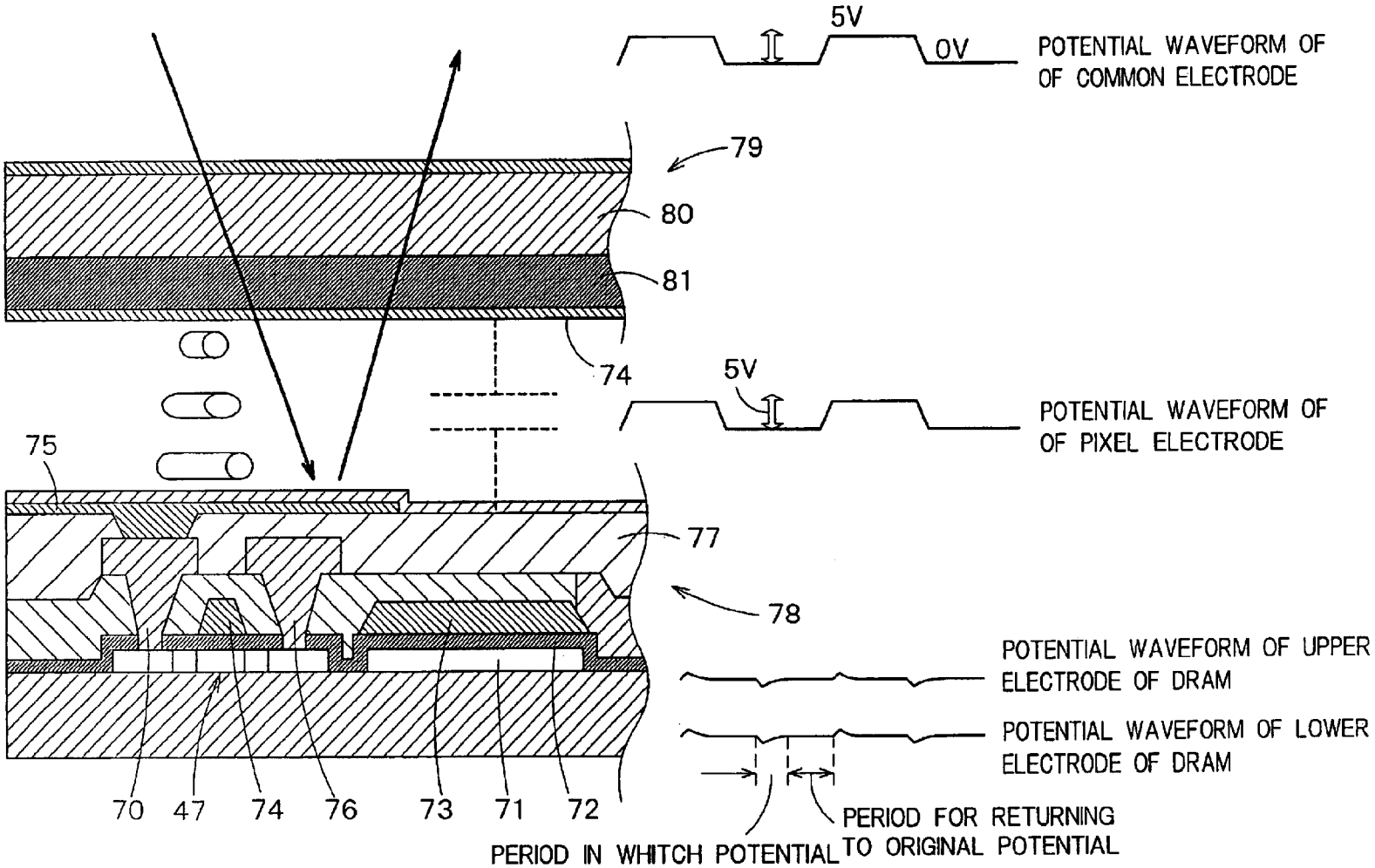
FIG. 17 is a diagram showing cross sectional structure of a liquid crystal display according to a second embodiment.

FIG. 17 is a diagram showing cross section structure of the liquid crystal display according to a second embodiment. The waveforms described to right side of FIG. 17 illustratively show a potential of the common electrode on the opposite substrate, a potential of the pixel electrode on the array substrate, upper electrode of the DRAM on the array substrate and the potential waveform of the lower electrode of the DRAM, in order from upper side, respectively. The potential of the common electrode alternatively becomes 0V or 5V at a prescribed cycle. The potential of the pixel electrode fluctuates at the same amplitude as that of the common electrode in accordance with the potential fluctuation of the common electrode, because the pixel electrode causes capacitance coupling with the common electrode. There is no likelihood in which the upper electrode of the DRAM fluctuates at the same amplitude as the potential of the pixel electrode in accordance the potential fluctuation of the pixel electrode, because the upper electrode of the DRAM is the power supply line or the ground line for supplying the power supply to the circuit in the pixel. In a moment in which the potential of the pixel electrode fluctuates, the potential of the upper electrode changes a little bit, and then soon returns to the original potential, because the electric charge is resupplied from the external power supply to the upper electrode. The lower electrode of the DRAM becomes high level or low level in accordance with the stored data. Although the voltage of the lower electrode fluctuates in accordance with that of the upper electrode, when the upper electrode returns to a prescribed potential, the potential of the lower electrode returns to a prescribed logic level. The liquid crystal display of FIG. 17 has a plurality of sub-display pixel electrodes each having different area ratio for each pixel and the DRAMs 43, and performs area gradation display.

The DRAM 43 is composed of the read/write control transistor 47 and the capacitor C3, similarly to FIG. 2. One electrode 71 composing the DRAM 43 is formed of the same material as poly-silicon being the material of the active layer of the read/write control transistor 47. On the upper face of the electrode 71, the other electrode 73 is formed via the insulation layer 72 made of oxide silicon. The other electrode 73 is set to ground level.

Thus, the reason why the other electrode 73 set to the ground level is arranged to near side of the opposite electrode 74 and the pixel electrode 75 is because the electrode set to be ground level is not affected on the potential fluctuation of the opposite electrode 74 and the pixel electrode 75.

The read/write control transistor 47 is formed on the insulation substrate by using the active layer 71 made of poly-silicon. The gate insulating film 72 made of oxide silicon is formed on the upper face of the active layer 71, and the gate electrode 74 made of MoW alloyed metal is formed on the gate insulating film 72. Source and drain electrodes 70 and 76 are formed back and forth of the gate electrode 74 via an interlayer insulation film made of oxide silicon. An interlayer insulation film 77 made of acrylic resin and so on is formed on the source and drain electrodes 70 and 76, and the pixel electrode 75 made of Al is formed on the interlayer insulation film 77.

The opposite substrate 79 arranged opposite to the array substrate 78 with such a structure has a color filter 81 of red, blue and green formed on the grass substrate 80 and an opposite electrode 82 which is made of a transparent electrode such as ITO and formed on the color filter 81.

The common voltage applied to the opposite electrode 82 periodically becomes 0V or 5V in order to perform polarity inversion drive. When the common voltage drastically changes from 0V to 5V, or from 5V to 0V, due to the change of voltage, there is a likelihood in which the voltage of the upper electrode (ground electrode) of the capacitor of the DRAM 43 fluctuates. The reason is why when the voltage fluctuation is too much large, the analog switch 83 of the DRAM 43 causes leak.

Figure 18:
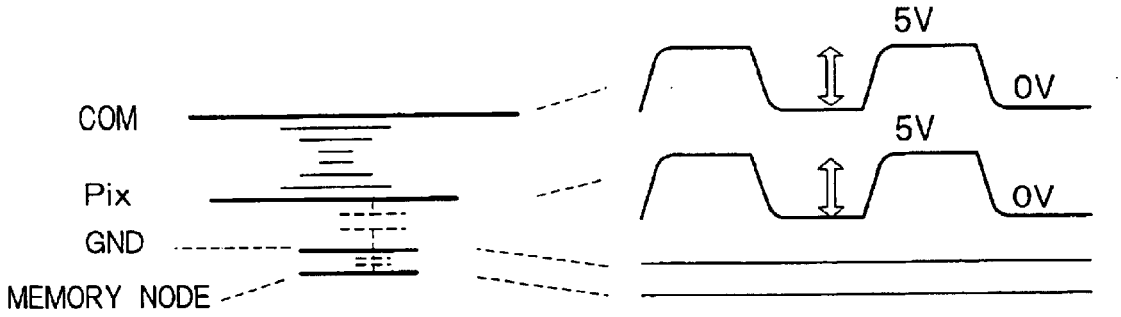
FIG. 18 is a diagram showing a common voltage waveform according to a second embodiment.

Because of this, in the present embodiment, the common voltage output circuit 61 of FIG. 15 rounds the voltage waveform of the common voltage as shown in FIG. 18. Therefore, the voltage fluctuation of the upper electrode of the capacitor is restrained, and the voltage fluctuation at both ends of the capacitor is restrained. The round amount of the waveform depends on screen size of the display apparatus, the number of pixels, liquid crystal material, the electric charge supplying ability of the power supply supplying the voltage to the upper electrode and so on. Roughly, the peak value of the potential fluctuation of the upper electrode during common inversion period should be roughly designed to be equal to or less than noise margin of the inverter IV1 and IV2 of the refresh circuit 44. Under the condition, even if the voltage at both ends of the capacitor fluctuates, the refresh circuit 44 can refresh the voltage stored in the DRAM 43 without misunderstanding the logic level.

Thus, in the second embodiment, because the ground electrode of the capacitor of the DRAM 43 is arranged to near side of the opposite electrode 74, and the voltage waveform of the common voltage supplied to the opposite electrode 74 is rounded, the voltage at both ends of the capacitor is not affected on the voltage fluctuation of the opposite electrode 74 and the pixel electrode, thereby improving the display quality.

(Third Embodiment)

A third embodiment shares one sub-pixel by a plurality of bits of digital pixel data.

Figure 19:
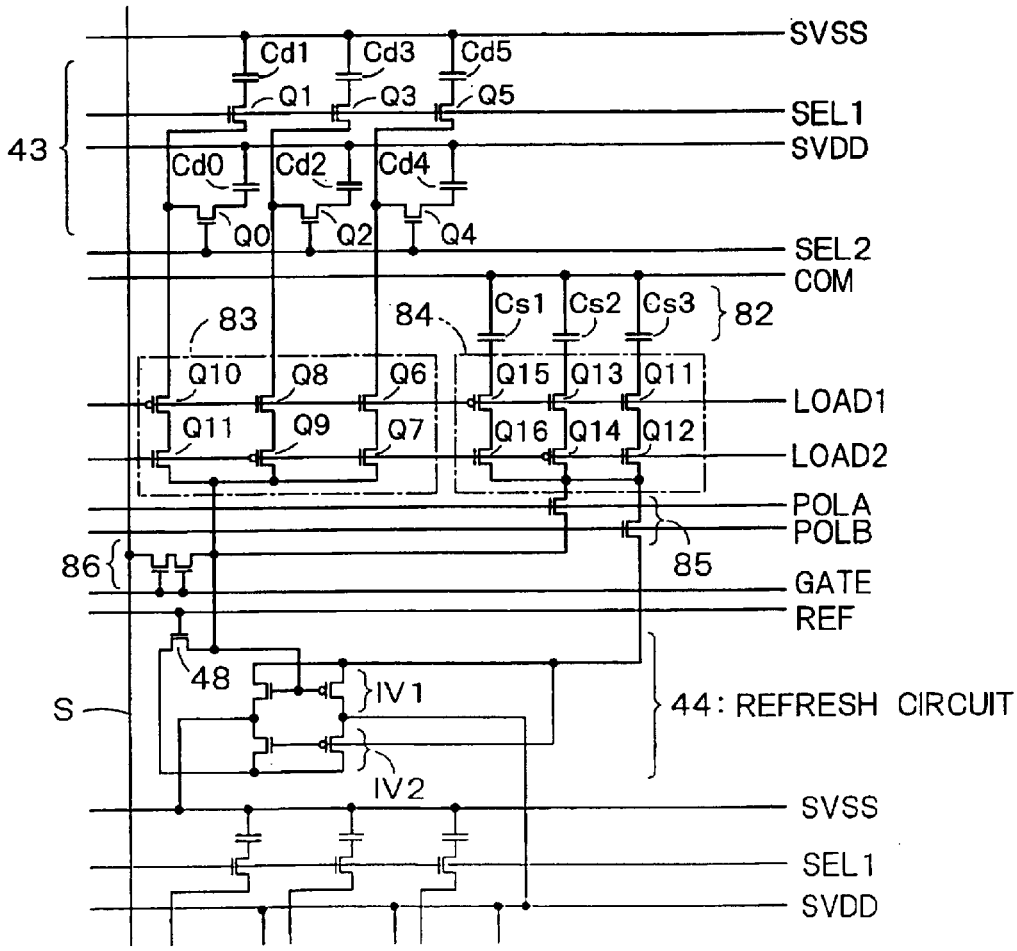
FIG. 19 is a circuit diagram showing circuit configuration for one pixel in a signal line drive circuit according to a third embodiment.

FIG. 19 is a circuit diagram showing circuit configuration of one pixel in the signal line drive circuit according to a third embodiment of a display apparatus of the present invention. FIG. 19 shows that the number of bits of the digital pixel data is six and each pixel has three sub-display pixels of area ratio 16:4:1. Practically, the circuit of FIG. 19 is provided one by one for each color of RGB, and one pixel is composed of these three circuits. In FIG. 19, an uncharacteristic portion of the signal line drive circuit is omitted.

The liquid crystal display apparatus of FIG. 19 has the DRAM 43 having six capacitors Cd0, Cd1, Cd2, Cd3, Cd4 and Cd5 provided in accordance with each bit of the digital pixel data, a refresh circuit 44 for holding the digital pixel data stored in the DRAM 43 in order for every one bit, an accumulating capacitor 82 consisted of three capacitors provided in accordance with each of three sub-display pixels for storing data held by the refresh circuit 44, a first switching part 83 for switching whether or not to transmit the digital pixel data stored in the DRAM 43 to the refresh circuit 44, a second switching part 84 for switching whether or not to transmit data held by the refresh circuit 44 to the accumulating capacitor 82, a polarity switching circuit 85, and a data import control circuit 86 for controlling whether or not to take in data on the signal line S.

The accumulating capacitor 82 stores the digital pixel data of 6 bits stored in the DRAM 43 in twice at each different timing for each different period, and three sub-display pixels perform display in accordance with data stored in the corresponding accumulating capacitor 82.

The refresh circuit 44 has two inverters IV1 and IV2 connected in series, and a transistor switch 48 connected between the output terminal of the inverter IV2 at subsequent stage and the input terminal of the inverter IV1 at forward stage.

Figure 20:
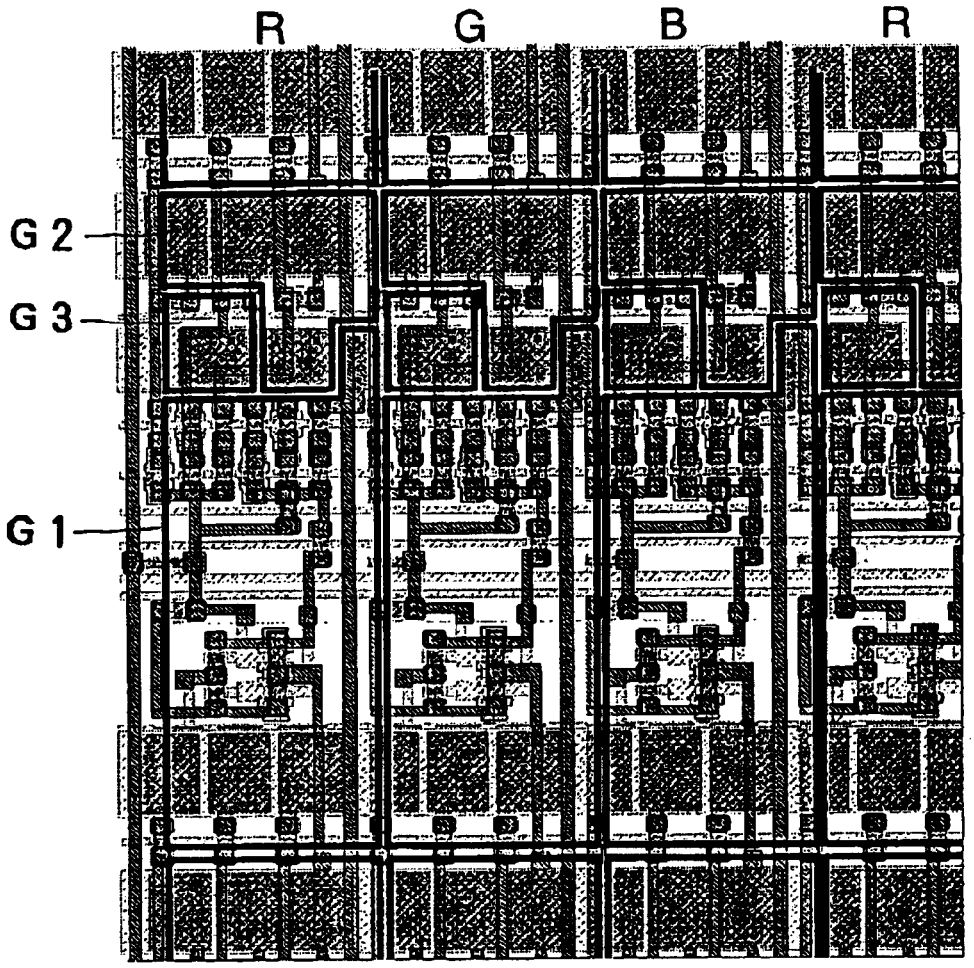
FIG. 20 is a plane layout diagram for one pixel according to a third embodiment of a display apparatus of the present invention.

FIG. 20 is a layout diagram for one bit according the third embodiment of the display apparatus of the present invention. In FIG. 20, the pixel electrodes G1, G2 and G3 are displayed with heavy-line frame. As shown in FIG. 20, the pixel electrodes G1, G2 and G3 with area ratio of 16:4:1 are provided for each color of RGB. Each of the pixel electrodes G1, G2 and G3 is connected to the accumulating capacitor 82.

Figure 21:
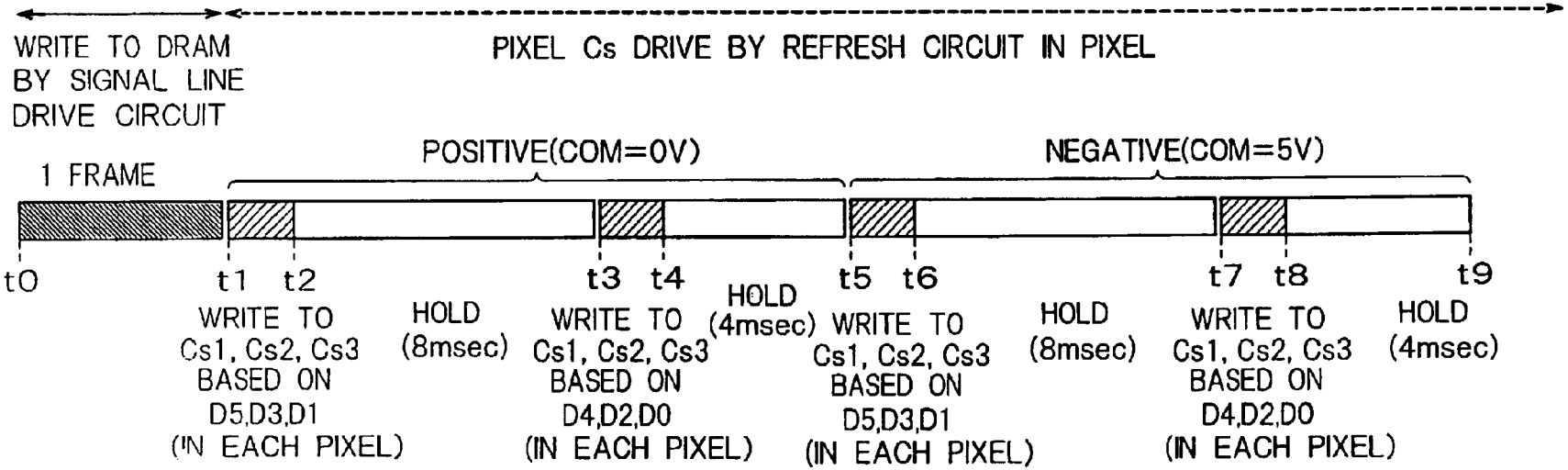
FIG. 21 is a display timing chart according to a third embodiment of a display apparatus of the present invention.

FIG. 21 is a display timing chart according to the third embodiment of the display apparatus of the present invention. As shown in FIG. 21, at time t0–t1, the digital pixel data for one frame is stored in the DRAM 43.

After then, at time t1–t5, the positive polarity data based on the digital pixel data stored in the DRAM 43 is divided into odd bits and even bits and is stored in the accumulating capacitor 82 in order. After then, at time t5–t9, the negative polarity data based on data stored in the DRAM 43 is divided into the odd bits and the even bits and stored in the accumulating capacitor 82.

Subsequently, as long as data displayed to the screen is not changed, the processings at time t1–t9 are repeated.

Hereinafter, the processings of time t1–t9 will be described in detail. First, at time t1–t2, among the digital pixel data for one frame stored in the DRAM 43, the positive polarity data corresponding to data of odd bits D5, D3 and D1 is stored in the accumulating capacitor 82.

Subsequently, at time t2–t3, data stored in the accumulating capacitor 82 is held. The display in accordance with odd bits D5, D3 and D1 is performed during this period. The period of time t2–t3 is, for example, 8 msec.

Subsequently, at time t3–t4, among the digital pixel data for one frame stored in the DRAM 43, the positive polarity data corresponding to data of the even bits D4, D2 and D0 is stored in the accumulating capacitor 82. After then, at time t4–t5, data stored in the accumulating capacitor 82 is held. The display in accordance with the even bits D4, D2 and D0 is performed during this period. The period of time t3–t4 is, for example, 4 msec.

Subsequently, at time t5–t7, the negative polarity data corresponding to the odd bits D5, D3 and D1 of the digital pixel data is stored in the accumulating capacitor 82 to display it. At time t7–t9, the negative polarity data corresponding to the even data D4, D2 and D0 of the digital pixel data is stored in the accumulating capacitor 82 to display it.

Thus, according to the present embodiment, the digital pixel data of 6 bits for one frame is separated into the odd bits and the even bits. The display is performed for 8 msec based on the values of the odd bits in the first half. The display is performed for 4 msec based on the value of the even bits in the second half. Because the area ratio of three pixel electrodes in one pixel is 16:4:1, (area×time) in the first half are 16×8, 4×8 and 1×8, respectively, and (area×time) in the second half are 16×4, 4×4 and 1×4, respectively. The ratio of these total six sets is 32:8:2:16:4:1. Therefore, $2^6$=64 gradation display is realized.

Figure 22:
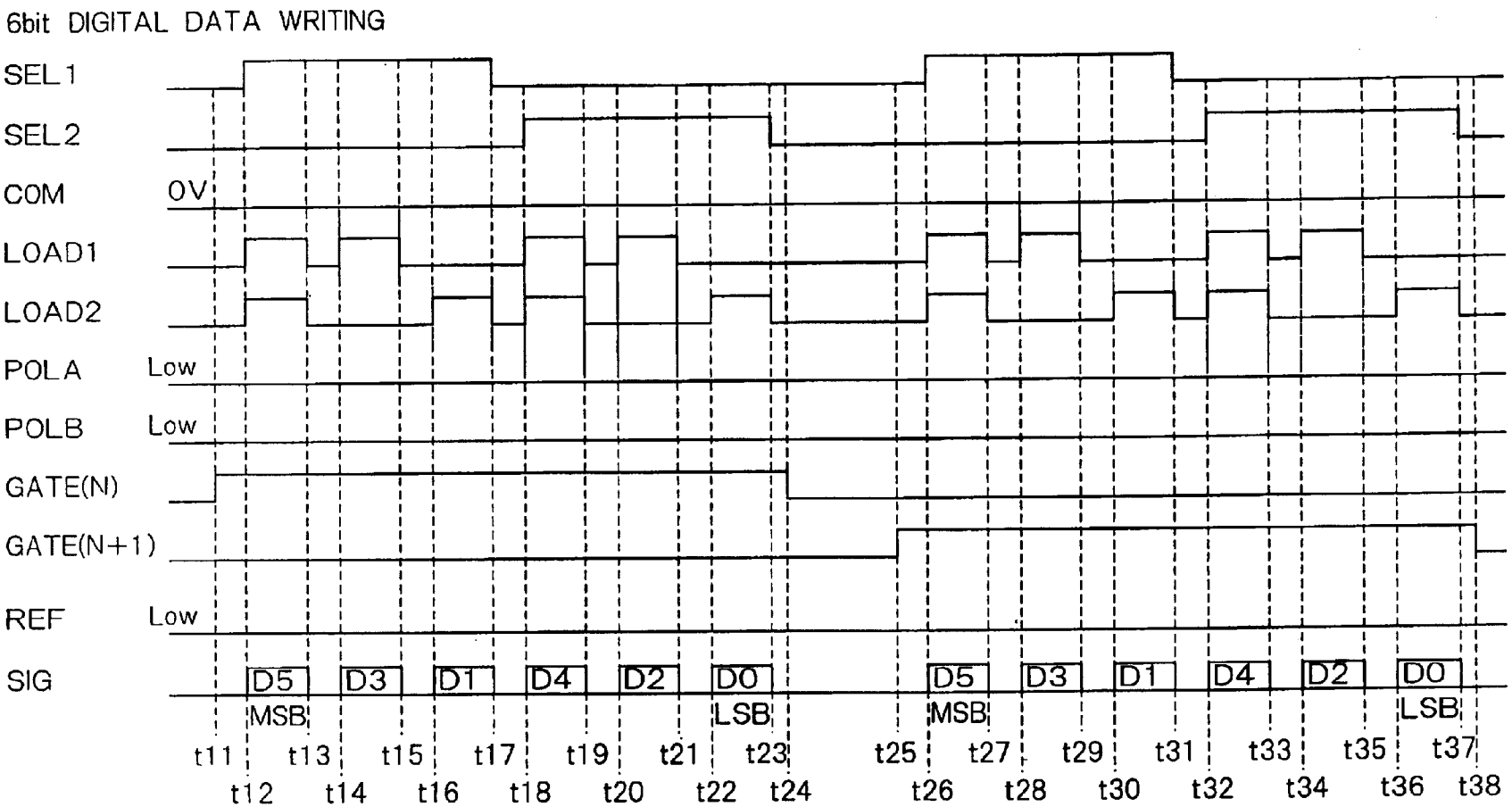
FIG. 22 is a detailed timing chart showing writing processings of digital pixel data to a DRAM.

FIG. 22 is a detailed timing chart showing the writing processing of the digital pixel data to the DRAM 43, which is performed at time t0–t1 of FIG. 21. At time t11–t24 of FIG. 22, the digital pixel data for one horizontal line is written into the DRAM 43, and at time t25–t38, the digital pixel data for next one horizontal line is written into the DRAM 43.

Hereinafter, the processings at time t11–t24 are more specifically described. At time t12–t17, the control signal SEL1 becomes high level, and the odd bits D1, D3 and D5 of the digital pixel data are stored in the capacitors Cd1, Cd3, Cd5, respectively. More specifically, at time t12–t13, the transistors Q6 and Q7 in the first switching part 83 turn on, and the digital pixel data of fifth bit applied to the signal line is written into the capacitor Cd5. After then, at time t14–t15, the transistors Q8 and Q9 in the first switching part 83 turn on, and the digital pixel data of third bit applied to the signal line is written to the capacitor Cd3. After then, at time t16–t17, the transistors Q10 and Q11 in the first switching part 83 turn on, and the digital pixel data of first bit applied to the signal line is written into the capacitor Cd1.

After then, at time t18–t23, the control signal SEL2 becomes high, and the digital pixel data D0, D2 and D4 of the odd bits are stored in the capacitors Cd0, Cd2 and Cd4, respectively. More specifically, at time t18–t19, the transistors Q6 and Q7 in the first switching part 83 turn on, and the digital pixel data of fourth bit applied to the signal line is written into the capacitor Cd4. After then, at time t20–t21, the transistors Q8 and Q9 in the first switching part 83 turn on, and the digital pixel data of second bit applied to the signal line is written into the capacitor Cd2. After then, at time t22–t23, the transistors Q10 and Q11 in the first switching part 83 turn on, and the digital pixel data of 0th bit applied to the signal line is written into the capacitor Cd0.

At time t25–t38, the same processings are performed with regard to the next horizontal line.

Figure 23:
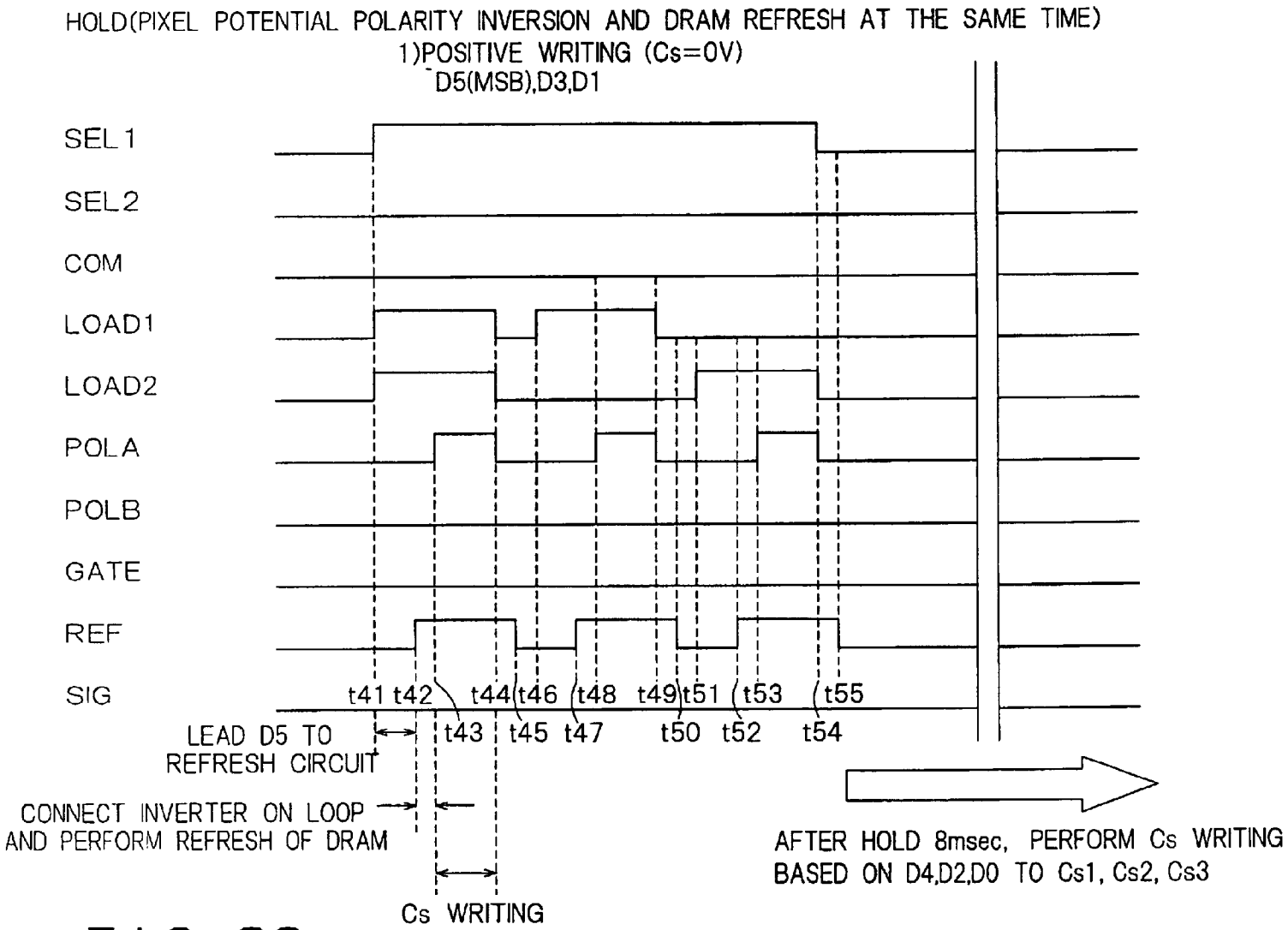
FIG. 23 is a timing chart showing a detailed writing operation to an accumulating capacitor.

FIG. 23 is a timing chart showing detailed writing operation to the accumulating capacitor 82, and shows an example in which the odd bits D5, D3 and D1 of the digital pixel data are written into the accumulating capacitor 82. In time t41 of FIG. 23, when the signal SEL1 is high level, and the signals LOAD1 and LOAD2 become high level, data stored in the capacitor Cd5 is transmitted to the refresh circuit 44.

Subsequently, at time t42, the signal REF becomes high, two inverters IV1 and IV2 in the refresh circuit 44 are connected in ring shape, and the refresh circuit 44 performs holding operation.

Subsequently, at time t43, the signal POLA becomes high, and the output of the inverter IV2 in the refresh circuit 44 is written to the capacitor Cs3 in the accumulating capacitor 82 at time t43–t44.

After then, at time t46, the signal LOAD1 becomes high level and the signal LOAD2 becomes low level. The data stored in the capacitor Cd3 in the DRAM 43 is stored in the capacitor Cs2 in the accumulating capacitor 82 at time t48–t49.

After then, at time t51, the signal LOAD1 becomes low level, and the signal LOAD2 becomes high level. Data stored in the capacitor Cd1 in the DRAM 43 is stored in the capacitor Cs1 in the accumulating capacitor 82 at time t53–t54.

After the above-mentioned operation is finished, and the prescribed period, for example, 8 msec lapses, data corresponding to the even bits D4, D2 and D0 of the digital pixel data is written into the accumulating capacitor 82.

Figure 24:
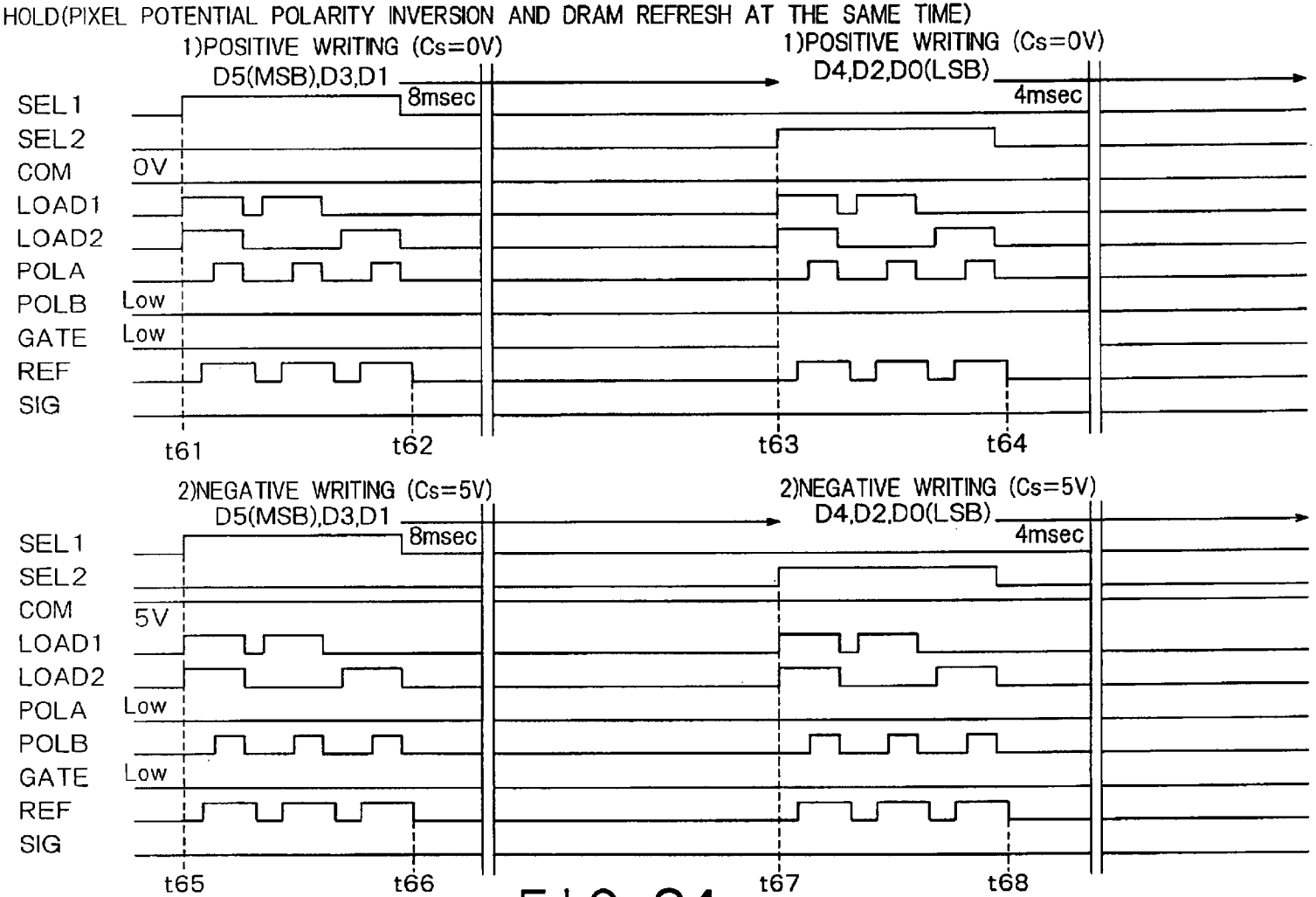
FIG. 24 is a timing chart showing a detailed writing processing to an accumulating capacitor for one frame.

FIG. 24 is a timing chart showing a detailed writing processings to the accumulating capacitor 82 for one frame. As shown in FIG. 24, the same processings as those of FIG. 23 are performed for every prescribed period (8 msec or 4 msec) in four times. More specifically, the positive polarity data corresponding to the odd bits D5, D3 and D1 of the digital pixel data is stored in the accumulating capacitor 82 at time t61–t62, and after 8 msec, the positive polarity data corresponding to the even bits D4, D2 and D0 of the digital pixel data is stored in the accumulating capacitor 82 at time t63–t64. After 4 msec, the negative polarity data corresponding to the odd bits D5, D3 and D1 of the digital pixel data is stored in the accumulating capacitor 82 at time t65–t66. After 8 msec, the negative polarity data corresponding to the even bits D4, D2 and D0 of the digital pixel data is stored in the accumulating capacitor 82 at time t67–t68.

Thus, according to the third embodiment, the digital pixel data is divided into odd bits and even bits, and is stored in the common accumulating capacitor 82 by staggering timing. Because of this, it is possible to decrease the number of the capacitors in the accumulating capacitor 82 in half of the number of the capacitors in the DRAM 43. Accordingly, it is possible to reduce the number of the capacitors and the number of the analog switches in the second switching part 84.

Furthermore, the first switching part 83 for switching data transmission from the DRAM 43 to the refresh circuit 44 and the second switching part 84 for switching data transmission from the refresh circuit 44 to the accumulating capacitor 82 are switched by common control signals LOAD1 and LOAD2, thereby reducing the number of wirings. By such an advantageous effect, according to the present embodiment, it is possible to increase the number of bits of area gradation per one pixel without increasing the area so much, and to realize high gradation display.

In the above-mentioned third embodiment, an example of performing the display based on the digital pixel data has been described. However, by using the circuit of FIG. 19, it is possible to perform display based on the analog gradation voltage. The timing chart at this case is shown in FIG. 25.

Figure 25:
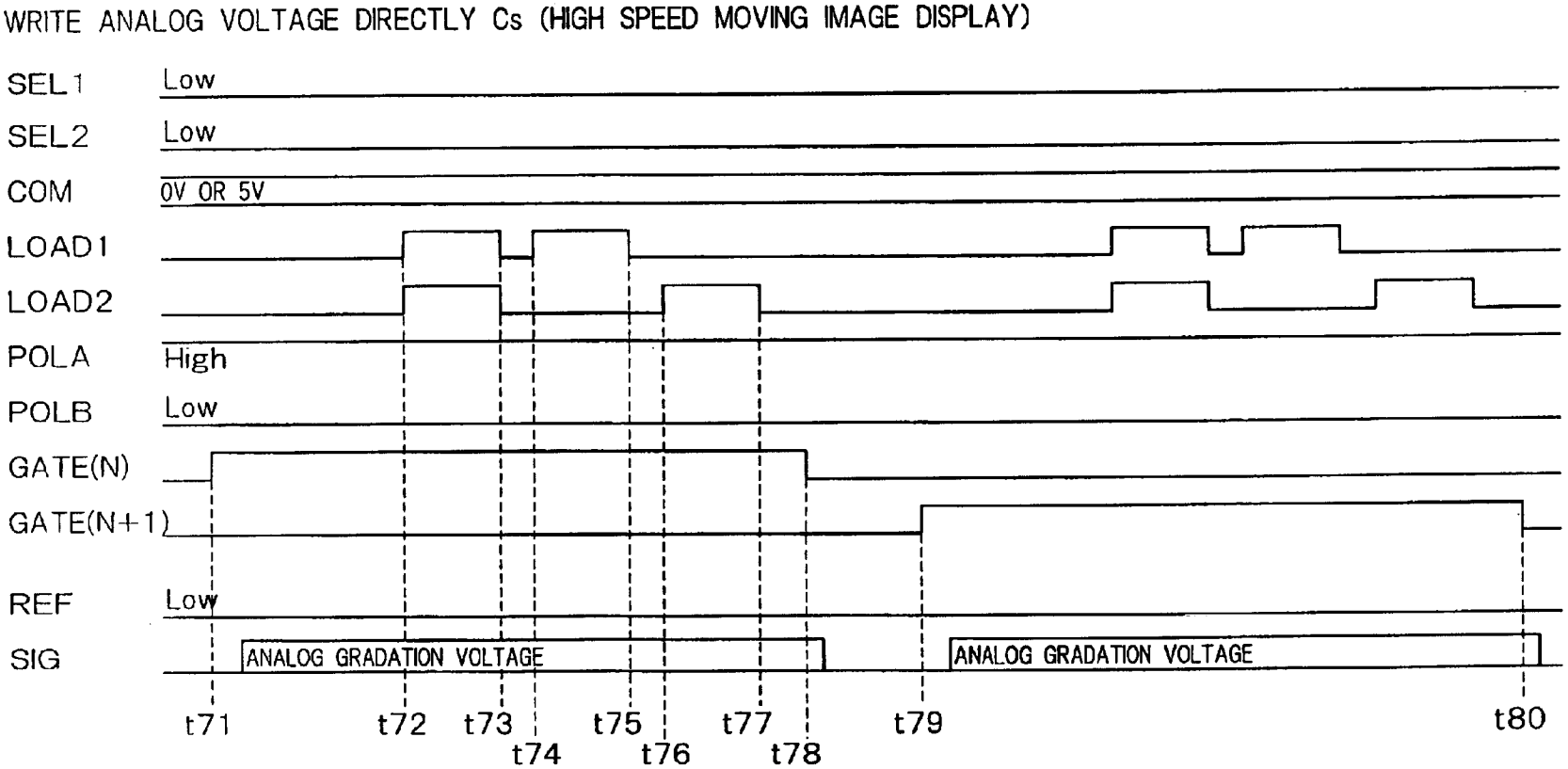
FIG. 25 is a timing chart showing an example of performing display based on an analog gradation voltage.

In the case of FIG. 25, the analog gradation voltage applied to the signal line is directly written into the accumulating capacitor 82. That is, the DRAM 43 and the first switching part 83 are not used.

The display for one horizontal line is performed during time t71–t78 of FIG. 25. The display for the next horizontal line is performed during time t79–t80.

Hereinafter, the display operation of time t71–t78 will be more specifically described. First, at time t72–t73, the signals LOAD1 and LOAD2 become high level, and data in accordance with the analog gradation voltage applied from the signal line is charged to the capacitor Cs3 in the accumulating capacitor 82.

Next, at time t74–t75, the signal LOAD1 becomes high level, and the signal LOAD2 becomes low level. Data in accordance with the analog gradation voltage supplied from the signal line is charged to the capacitor Cs2 in the accumulating capacitor 82.

Next, at time t76–t77, the signal LOAD1 becomes low level, and the signal LOAD2 becomes high level. Data in accordance with the analog gradation voltage supplied from the signal line is charged to the capacitor Cs1 in the accumulating capacitor 82.

Thus, when performing the analog writing, the writing to three capacitors Cs1, Cs2 and Cs3 is performed based on the same analog gradation voltage. Because the analog writing does use neither the DRAM 43 nor the first switching part 83, the operation is simpler than that of the above-mentioned digital writing. Accordingly, the analog writing is suitable to the case in which it is necessary to switch the screen at high speed such as moving image display.

In the present embodiment, the example in which the number of time division is two, the number of division of the pixel portion is three, and by this combination, the gradation display of 6 bits is performed, has been described. The number of time division and the number of division of the pixel portion are not limited to the above-mentioned one. For example, the other example in which the number of time division is three, and the number of division of the pixel portion is two, is also possible. In this case, the ratio of time division is set to be 16:4:1, and the ratio of the division of the pixel portion is set to be 2:1. Summarily, if the product of (area×time) becomes 2n (n=0, 1, . . . 5), the same gradation display is possible.

In the present embodiment, although the period of two time division has been set to be 8 msec and 4 msec, the time length is not limited to 8 msec and 4 msec. For example, the time length may be 6 msec and 3 msec. Although it is effective to set the time as long as possible in order to reduce power consumption, the effective voltage to the liquid crystal may become lower, thereby occurring flicker and deteriorating visibility. Accordingly, it is desirable to set time as long as possible at range in which the flicker does not occur.

In the present embodiment, when the potential of the common electrode is inverted at a prescribed cycle, the potential of the pixel electrode fluctuates due to coupling, and whether or not the logic level of the DRAM provided below the pixel electrode can be held normally has been described in detail. Even in the driving method of holding the potential of the common electrode to a constant potential, it is effective to normally hold the logic level of the DRAM when the pixel potential fluctuates by the potential inversion and so on during the period in which the DRAM is in high impedance state (state in which the electric charge is not supplied).

(Four Embodiment)

In the above-mentioned embodiment, an example in which the present invention is applicable to the liquid crystal display has been described. However, the present invention is also applicable to an EL (electro luminescence) display apparatus.

Figure 26:
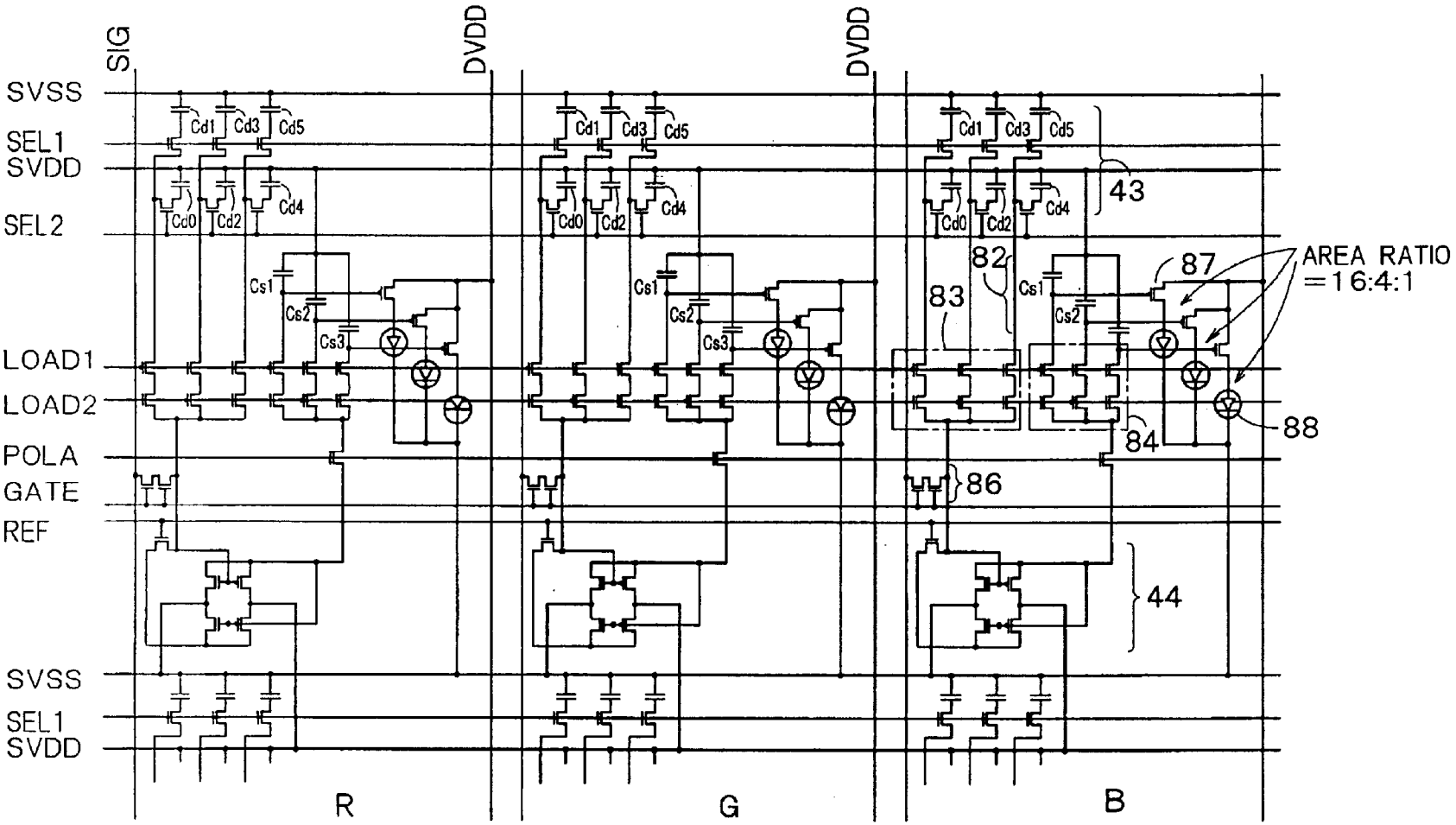
FIG. 26 is a circuit diagram showing circuit configuration for one pixel in a signal line drive circuit according to a fourth embodiment of a display apparatus according to the present invention.

FIG. 26 is a circuit diagram showing circuit configuration for one pixel in the signal line drive circuit according to a four embodiment of a display apparatus of the present invention. The display apparatus of FIG. 26 is an EL display apparatus, and shows an example in which three sub-display EL light-emitting parts with area ratio 16:4:1 are provided for each color of RGB.

The EL display apparatus of FIG. 26 has a the DRAM 43 having the same configuration as that of FIG. 19, the refresh circuit 44, the accumulating capacitor 82, a first switching part 83, a second switching part 84 and a data import control circuit 86.

In the EL display apparatus, because it is unnecessary to perform the polarity inverting drive, the polarity inversion circuit is omitted.

A gate terminal of a light control TFT 87 is connected to each of the accumulating capacitor 82, an EL display element 88 is connected to the drain terminal of the TFT 87, and a power supply line DVDD is connected to the source terminal.

When the light control TFT 87 is in ON, if the power supply line DVDD becomes a high level voltage, the EL display element 88 turns on a light. Even if the power supply line DVDD is in high level voltage, when the light control TFT 87 is in off state, the EL display element 88 does not turn on a light.

Figure 27:
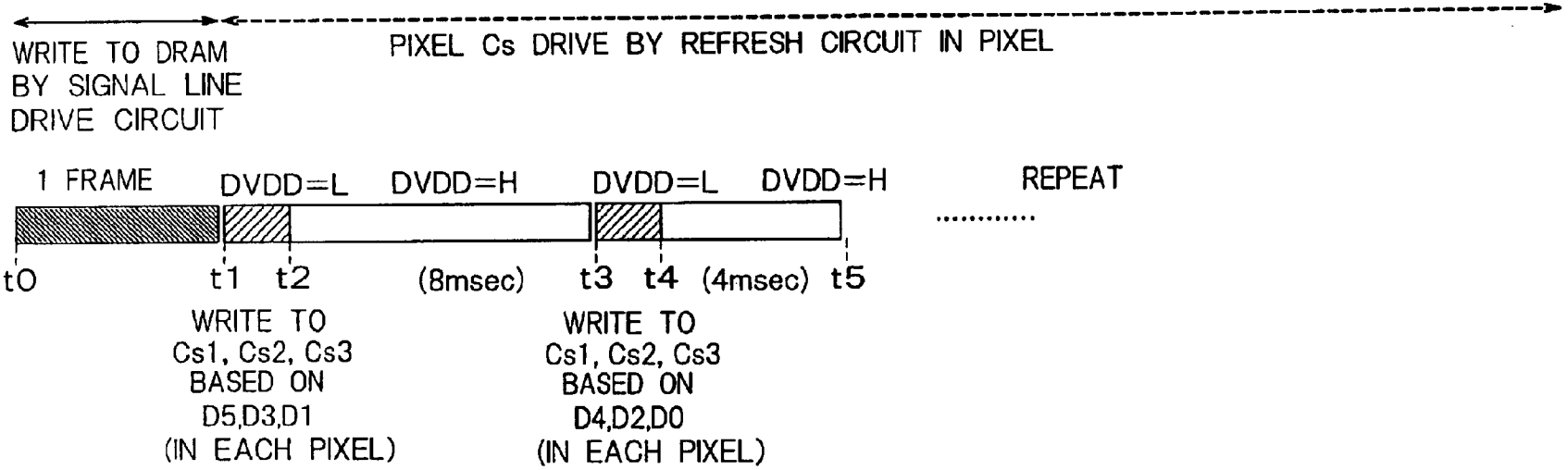
FIG. 27 is a diagram showing drive timing of an EL display apparatus of FIG. 26.
Figure 28:
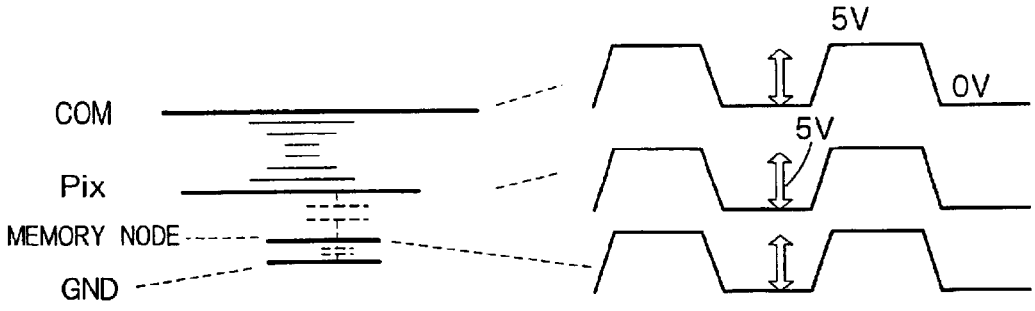
FIG. 28 is a diagram schematically showing location relationships between an opposite electrode and a pixel electrode, and between electrodes at both ends of a capacitor.
Figure 29:
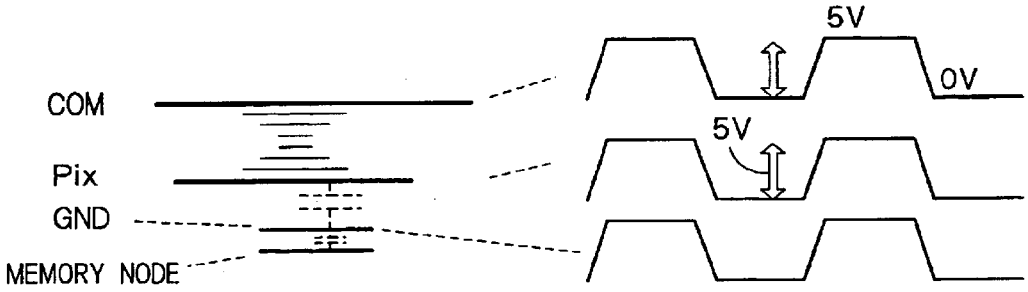
FIG. 29 is a diagram showing an example in which a ground electrode of a capacitor is arranged above the other electrode.

FIG. 27 is a diagram showing drive timing of the EL display apparatus of FIG. 26. As evidenced by comparing FIG. 27 with FIG. 21, because the present embodiment does not perform the polarity inverting drive, the timing control of FIG. 27 is easier than that of FIG. 21.

First, at time t0–t1, the digital pixel data for one frame is stored in the DRAM 43. After then, at time t1–t5, the digital pixel data stored in the DRAM 43 is divided into odd bits and even bits, and is stored in the accumulating capacitor 82 in order. After then, the processings of time t1–t5 are repeated.

The period (time t2–t3=8 msec) for driving the EL display element 88 based on the odd bits of the digital pixel data is twofold of the period (time t4–t5=4 msec) for driving the EL display element 88 based on the even bits. Because of this, the values of (area×time) of time t2–t3 become 16×8, 4×8 and 1×8, respectively, and the values of (area×time) of time t4–t5 become 16×4, 4×4 and 1×4, respectively. The ratio of these six sets becomes 32:8:2:16:4:1. Therefore, $2^6$=64 gradation display is realized.

Thus, even when the present invention is applied to the EL display apparatus, $2^n$ gradation display is realized by the accumulating capacitors 82 and the EL display elements 88 having the half of the number n of bits of the digital pixel data, thereby simplifying the configuration of the pixels.

In the present embodiment, although the period in which the power supply line DVDD is in H level has been set to be 8 msec and 4 msec, the time length is not limited to 8 msec and 4 msec. In the sight of the refresh of the DRAM, it is assumed to become low power consumption as the time length is long.

On the other hand, from the viewpoint of the DRAM refresh, when time is too much long, the time interval at which one DRAM is refreshed becomes too much long, the voltage level of the DRAM deteriorates too much until the level which is not adjusted by the refresh circuit. Therefore, there is a likelihood in which correct light control becomes impossible. The deterioration of the voltage level of the DRAM becomes lower as the leak current of the switch is small. The length of the lighting period should be optimized from these viewpoints.

In the present embodiment, although the refresh circuit composed of two inverters connected in loop shape has been used, the configuration of the refresh circuit is not limited to the above-mentioned one. The refresh circuit should able to adjust the logic level of the DRAM 43, and supply the sufficient on/off voltage to the light control TFT 87. For example, the adjustment of the logic level of the DRAM 43 may be performed by 0 or 5 volt, and the supply of the light control voltage to the accumulating capacitor may be performed by −2 volt or 8 volt. In this configuration, the level shifter of arbitrary configuration may be inserted between the refresh circuit 44 of FIG. 26 and the switching circuit 84.

Even in the present embodiment, the number of time division and the number of the division of the lighting part are not limited.

In the present embodiment, although it is assumed that the product of (area×time) becomes $2^n$(n=0, 1, . . . 5), according to the characteristics of the actual EL element, the adjustment to be a little bit of different value from $2^n$ is also effective. The area, the time and the DVDD voltage level may be adjusted in accordance with colors by degrees.

The above-mentioned display apparatus according to the first to fourth embodiments can stop the signal line drive circuit after writing data for one screen into the memory of each pixel in order to display the still image, thereby saving power consumption to a large degree. The reason is why the display control operation in the pixel is sufficiently small, as compared with the operation of the signal line drive circuit.

What is claimed is:

1. A display apparatus, comprising:

signal lines and scanning lines arranged vertically and horizontally;

a plurality of display pixel parts connected to said signal lines and scanning lines; and a display control part which applies image data to said plurality of display pixel parts, wherein said display pixel part includes:

a plurality of sub-display pixels which perform display in accordance with analog pixel data and digital pixel data alternatively applied to the corresponding signal line; and a plurality of one bit memories which store the digital pixel data applied to the corresponding signal line, wherein said display control part changes the order of the analog pixel data applied to the signal lines and the order of the digital pixel data applied to the signal lines.

2. The display apparatus according to claim 1, wherein said display control part divides the signal lines into a plurality of groups, and applies the pixel data or to the corresponding signal line in order for each group, when said plurality of sub-display pixels perform display based on the analog pixel data.

3. The display apparatus according to claim 1, wherein said display control part applies the pixel data to the corresponding signal line for each bit of the digital pixel data, when said plurality of sub-display pixels perform display based on the digital pixel data.

4. The display apparatus according to claim 1, wherein said display control part includes:

a plurality of latch parts which latches the digital pixel data;

a D/A converter which converts data latched by said plurality of latch parts into the analog pixel data;

a multiplexer which selects either of the outputs of said plurality of latch parts or the output of said D/A converter;

an amplifier which performs current amplification of the output of said multiplexer; and a selector which supplies the output of said amplifier to the corresponding signal line.

5. The display apparatus according to claim 4, wherein said plurality of latch parts latch all the bits of the digital pixel data corresponding to the analog pixel data applied to one signal line at the same time, when said plurality of sub-display pixels perform display based on said analog pixel data; and said multiplexer selects the analog pixel data outputted from said D/A converter and applies the analog pixel data to said amplifier.

6. The display apparatus according to claim 4, wherein said plurality of latch parts latch certain bits of a plurality of digital pixel data corresponding to a plurality of signal lines different from each other, respectively, in the case of performing display to said plurality sub-display pixels based on said digital pixel data; and said multiplexer selects the digital pixel data latched by said plurality of latch parts in order and provides the selected digital pixel data to said amplifier.

7. The display apparatus according to claim 1, wherein said display pixel part includes a refresh part which performs refresh operation of data stored in said plurality of one bit memory; and said display pixel part reads out data stored in said plurality of one bit memory to perform display of said plurality of sub-display pixels, and periodically refreshes said plurality of one bit memories by said refresh part.

8. The display apparatus according to claim 1, wherein said display control part applies a partial analog pixel data including the altered portion to the corresponding signal line, when there is a change to only a portion of the image displayed to the display screen; and said display pixel part updates display of said corresponding plurality of sub-display pixels based on said partial analog pixel data, and performs the display of said plurality of sub-display pixels based on data stored in said plurality of one bit memories with regard to the other display area.

9. A display system comprising a display controller which outputs digital pixel data in prescribed order and a display apparatus which performs display in accordance with the digital pixel data outputted from said display controller, wherein said display apparatus includes:

a plurality of pixel blocks;

a pixel storing part which is provided for each pixel block and stores the digital pixel data applied from the signal lines; and a display selecting part which is provided for each pixel block and selects either to perform display in accordance with analog pixel data applied to the signal lines or to perform display in accordance with the digital pixel data stored in the corresponding pixel storing part, wherein said display controller outputs said digital pixel data in order different from each other in the case in which said display apparatus performs display in accordance with the analog pixel data applied to the signal lines and the case in which said display apparatus performs display in accordance with the digital pixel data stored in said pixel storing part.

10. A display apparatus, comprising:

signal lines and scanning lines arranged vertically and horizontally;

a plurality of display pixel parts connected to said signal lines and scanning lines; and a display control part which applies pixel data to said plurality of display pixel parts, wherein said display control part has n pieces of sub-display pixels which performs display in accordance with digital pixel data of m×n bits (m and n are an integer equal to or more than one) provided to the corresponding signal line lines, m and n being an integer, wherein said display control part includes:

a pixel storing part which includes m×n pieces of capacitors each storing the corresponding bit of the digital pixel data of m×n bits;

a holding circuit which holds the digital pixel data of m×n bits stored in said pixel storing part in order for each bit; and an accumulating capacitor which includes n pieces of capacitors each being provided corresponding to each of said n pieces of sub-display pixels, and stores data held by said holding circuit, wherein said accumulating capacitor holds data corresponding to said digital pixel data of m×n bits in m times at each different timing for each different period.

11. The display apparatus according to claim 10, wherein said display control part stores the digital pixel data for one frame into said pixel storing part, allows n bits among said digital pixel data of m×n bits in order for every one bit to hold by said hold circuit, stores the held data into said accumulating capacitor with first voltage polarity, allows the remaining n bits in order for every one bit to hold by said hold circuit, stores the held data into said accumulating capacitor with the first voltage polarity, allows n bits among said digital pixel data of m×n bits in order for every one bit to hold by said hold circuit, stores the held data into said accumulating capacitor with a second voltage polarity, allows the remaining n bits in order for every one bit to hold by said hold circuit, and then stores the held data into said accumulating capacitor with second voltage polarity.

12. The display apparatus according to claim 10, wherein said n pieces of sub-display pixels are n pieces of EL (electro luminescence) elements;

said display control part has n pieces of light control transistors which controls lighting of each of said n pieces of EL elements; and each of said n pieces of light control transistors turns on/off based on the charged electric charge of the corresponding capacitor of said accumulating capacitor.

13. The display apparatus according to claim 12, wherein said display control part stores the digital pixel data for one frame into said pixel storing part, allows n bits among the digital pixel data of m×n bits in order for every one bit to hold by said hold circuit, stores the held data into said accumulating capacitor, allows the remaining n bits in order for every one bit to hold by said hold circuit, and then stores the held data into said accumulating capacitor.

14. The display apparatus according to claim 10, wherein said display control part divides said digital pixel data of m×n bits into two groups of odd bits and even bits, reads out from said pixel storing part in order for every one bit for each group, allows the read-out data to hold by said hold circuit, and stores the held data into said accumulating capacitor.

15. The display apparatus according to claim 10, wherein said display control part includes:

a first switching part which switches whether or not to transmit the digital pixel data stored in said pixel storing part to said hold circuit; and a second switching part which switches whether or not to transmit the data held by said hold circuit to said accumulating capacitor.

16. The display apparatus according to claim 15, wherein said first switching part transmits n bits among the digital pixel data of m×n bits in order for every one bit to said hold circuit, and transmits the remaining n bits to said hold circuit in order for every one bit, and said second switching part transmits data held by said hold circuit to each of said n pieces of capacitors in said accumulating capacitor.

17. The display apparatus according to claim 16, wherein said first switching part transmits one of the odd bits or the even bits among the digital pixel data of m×n bits in order for every one bit to said bold circuit, and then transmits the other of the odd bits or the even bits in order for every one bit to said hold circuit.

18. The display apparatus according to claim 15, wherein said first and second switching parts has n pieces of analog switches, respectively; and the analog switches are controlled to ON/OFF in accordance with a common control signal.

19. The display apparatus according to claim 15, wherein said holding circuit includes:

two inverters connected in series; and a switch which switches whether or not to conduct an input terminal of said inverter at initial stage to an output terminal of said inverter at subsequent stage, wherein at the state of cutting off a connecting path between the input terminal of said inverter at initial stage and the output terminal of said inverter at subsequent stage by turning off said switch, the digital pixel data stored in said pixel storing part is inputted to said inverter at initial stage via said first switching part, and then at the state of turning on said switch, the outputs of said inverters at initial and subsequent stages are transmitted to said accumulating capacitor via said second switching part.

20. A display apparatus, comprising:

signal lines and scanning lines arranged vertically and horizontally;

a plurality of display pixel parts connected to said signal lines and scanning lines; and a display control part which applies pixel data to said plurality of display pixel parts, wherein said display pixel part includes:

n (n is an integer equal to or more than one) pieces of EL (electro luminescence) elements which performs display in accordance with digital pixel data applied to the corresponding signal line;

n pieces of light control transistors which controls lighting of said m pieces of EL elements;

n pieces of one bit memories which controls ON/OFF of said n pieces of light control transistors; and a hold circuit which holds digital pixel data of m (m is an integer than n) bits;

wherein said n pieces of one bit memories hold said digital pixel data of m bits in multiple times at each different timing for each different period.

21. A method of driving a display apparatus which comprises signal lines and scanning lines arranged vertically and horizontally; a plurality of display pixel parts connected to said signal lines and scanning lines; and a display control part which applies pixel data to said plurality of display pixel parts, wherein said display pixel part has n pieces of sub-display pixels which perform display in accordance with the digital pixel data of 2n (n is an integer equal to or more than one) bits applied to the corresponding signal line;

said display control part includes:

a pixel storing part which is consisted of 2n pieces of capacitor elements and stores the digital pixel data of 2n bits;

a hold circuit which holds the digital pixel data of 2n bits stored in said pixel storing part in order for every one bit; and an accumulating capacitor part consisted of n pieces of capacitors which is provided corresponding to each of said n pieces of sub-display pixels and stores data held by said hold circuit, wherein after storing the digital pixel data for one frame into said pixel storing part, n bits among said digital pixel data of 2n bits is held by said hold circuit in order for every one bit, and then stored into said accumulating capacitor with a first voltage polarity;

the remaining n bits is held by said hold circuit in order for every one bit, and then is stored into said accumulating capacitor with said first voltage polarity;

n bits among said digital pixel data of 2n bits is held by said hold circuit in order for every one bit, and then stored into said accumulating capacitor with a second voltage polarity; and the remaining n bits is held by said hold circuit in order for every one bit, and then is stored into said accumulating capacitor with said second voltage polarity.

* * * * *